US005629587A

United States Patent [19]

Gray et al.

[11] Patent Number: 5,629,587

[45] Date of Patent: May 13, 1997

[54] PROGRAMMABLE LIGHTING CONTROL SYSTEM FOR CONTROLLING ILLUMINATION DURATION AND INTENSITY LEVELS OF LAMPS IN MULTIPLE LIGHTING STRINGS

[75] Inventors: Roger M. Gray; Barry C. Kockler, both of Lewisville, Tex.

[73] Assignee: Devtek Development Corporation, Lewisville, Tex.

[21] Appl. No.: 533,921

[22] Filed: Sep. 26, 1995

[51] Int. Cl.[6] ..... G05F 1/00

[52] U.S. Cl. ..... 315/292; 315/293; 315/294; 315/314

[58] Field of Search ..... 315/291, 292, 315/293, 294, 297, 307, 314, DIG. 4, DIG. 7

[56] References Cited

U.S. PATENT DOCUMENTS

| | | | |
|---|---|---|---|
| 3,623,066 | 11/1971 | Norris | 340/324 R |
| 3,934,249 | 1/1976 | Sanjana | 340/340 |
| 4,016,474 | 4/1977 | Mason | 320/15 |
| 4,095,139 | 6/1978 | Symonds et al. | 315/153 |
| 4,125,781 | 11/1978 | Davis, Jr. | 307/11 |
| 4,215,277 | 7/1980 | Weiner et al. | 307/41 |
| 4,276,610 | 6/1981 | Fleck | 364/900 |
| 4,425,630 | 1/1984 | Yomogida et al. | 364/900 |
| 4,437,169 | 3/1984 | Bertenshaw et al. | 364/900 |
| 4,678,926 | 7/1987 | Davis | 307/11 |
| 4,833,589 | 5/1989 | Oshiga et al. | 364/140 |
| 4,890,000 | 12/1989 | Chou | 307/36 |
| 5,008,595 | 4/1991 | Kazar | 315/178 |
| 5,059,871 | 10/1991 | Pearlman | 315/316 |
| 5,187,655 | 2/1993 | Post et al. | 364/146 |
| 5,209,560 | 5/1993 | Taylor et al. | 362/85 |
| 5,300,864 | 4/1994 | Allen, Jr. | 315/314 |
| 5,329,431 | 7/1994 | Taylor | 362/85 |
| 5,406,176 | 4/1995 | Sugden | 315/292 |

*Primary Examiner*—Robert Pascal
*Assistant Examiner*—David Vu
*Attorney, Agent, or Firm*—Martin Korn

[57] ABSTRACT

A programmable lighting control system for advertising, decorative, artistic, and Christmas lighting applications, consists of a standalone controller, an optional power booster device, and a personal computer compatible software program. The controller receives power via a standard AC outlet receptacle and includes: a plurality of AC output receptacles for connection to either series or parallel connected Christmas tree type lights or the like; a microcontroller to provide timing and control signals that are applied to solid state switching devices to drive the outlet receptacles; a non volatile memory to store custom user defined lighting sequences; a rotary, switch to enable the selection of either pre-programmed sequences or user defined sequences; and a serial communication port. The personal computer compatible software program enables the user to create custom lighting sequences, which can be downloaded to the light controller non volatile memory via the serial port. The optional power booster device can be used to increase the output power capability of each of the individual controller output circuits.

23 Claims, 14 Drawing Sheets

PROGRAMMABLE LIGHTING CONTROL SYSTEM FOR CONTROLLING ILLUMINATION DURATION AND INTENSITY LEVELS OF LAMPS IN MULTIPLE LIGHTING STRINGS

TECHNICAL FIELD OF THE INVENTION

The present invention relates to a programmable controller, and more particularly to a controller for controlling the illumination timing and intensity of a plurality of sets of series or parallel connected bulbs used for advertising, entertainment, decorative, artistic, or Christmas lighting applications.

BACKGROUND OF THE INVENTION

Prior patents have been granted for devices that control lighting parameters for applications in the entertainment and decorative lighting fields. These patents describe methods for controlling the amount and/or duration of power applied to vary the brightness or intensity and the ON/OFF time of a light bulb or string of light bulbs. Both electronic and electro-mechanical (motor driven cam) methods have been utilized to control the ON/OFF time and intensity for the subject lighting applications. The previous patents in the decorative or entertainment lighting field that deal with controllers, sequencers, flashers, and dimmers can be divided into two categories: programmable sequences, and fixed or selected sequences.

Prior patents that fall into the programmable sequence category, have been granted for sophisticated stage and entertainment lighting systems. The high end controller, in this category, is capable of complex control of several hundred lights including: light sequencing, motion, position, intensity, color, pattern, beam size, and audio response. These types of controllers are used in the entertainment and disco club field and generally consist of a plurality of automated lamp units connected to a remote console controller via an intelligent data link system. Systems of this type are disclosed in U.S. Pat. Nos. 5,209,560, and 5,329,431. The low end controller, in this category,, allows limited programming by setting multiple dials and switches or audio input to control the ON/OFF flash rate and intensity of a small number of lights, typically four to six.

The second category contains devices with single or multiple fixed sequences that are predetermined by the manufacturer, and includes electro-mechanical controllers where the ON/OFF sequences are generated by motor driven cams that operate switches to provide the capability of switching high levels of power, required for commercial lighting applications. Lighting intensity control can also be realized by a electro-mechanical device as disclosed in U.S. Pat. No. 4,678,926.

Other devices in the fixed or selectable sequence category are described as control units with multiple outlets for connecting lighting sets to be controlled by electronic devices contained inside the base of the unit, such as U.S. Pat. No. 5,300,864. Also included are configurations where the controller and outlet receptacles are molded into the wiring harness as represented in by U.S. Pat. No. 4,215,277. This category also contains controllers for special lighting applications such as shown in U.S. Pat. No. 3,934,249. In general, the controllers in this category do not include intensity control and use uniformly spaced ON/OFF time intervals. Several of the patents in this category are called "programmable", but actually consist of user selected fixed sequences, with usually either a blinker/flasher or a sequencer but generally not both.

A need has thus arisen for a user programmable sequencing light controller, with the capability of both uniform and non uniform ON/OFF time control and variable intensity control, employing solid-state circuitry, for the control of a plurality of individual sets of series or parallel connected Christmas tree lighting strings or the like which allows the user to create a truly unique, personalized, custom lighting display sequence. Unlike previous devices where the control unit is limited to a predetermined group of fixed patterns, a need has arisen for a controller which provides unlimited flexibility and allows the user to create a near infinite number of unique and personalized lighting displays.

SUMMARY OF THE INVENTION

In accordance with the present invention, a programmable solid state electronic control system controls the ON/OFF time and the intensity of a plurality of sets of series or parallel connected lighting strings used for either indoor or outdoor decorative, artistic, attention gathering displays, display signs, advertising, entertainment or seasonal lighting applications. The control system includes a plurality of power outlets for connection to a plurality of lighting strings. The outlets are individually controlled via respective individual electronic switches that are controlled by individual lighting condition signals produced by a controller microprocessor, according to the setting of the selection switch as determined by the user. The lighting condition signals are applied to the gate element of a solid-state switching device which applies or denies AC power to the corresponding outlet. The timing phase of the lighting condition signal is synchronized with the zero crossing of the AC line frequency. Intensity control of an individual outlet is accomplished by the control of the amount of time delay between the lighting condition signal and the time of the zero crossing of the AC line frequency. The AC input power also passes through a transformer and is full-wave rectified to produce a low DC voltage, needed to power the controller timing, logic and memory circuits.

The present invention has use in low end applications such as upscale residential holiday lighting displays and low end commercial lighting displays. As such the present invention is simple, low cost, and compatible with high volume manufacturing techniques.

Another aspect of the present invention is to provide a lighting control system, as previously described, that has both pre-determined fixed lighting sequences and custom user created lighting sequences.

Another aspect of the present invention is to provide a lighting control system, as previously described, that contains a serial data interface, which will allow the light controller to communicate with the user application software, which resides on a personal computer, PC, compatible machine.

A further aspect of the present invention is to provide a PC compatible application software program, which allows the user to create programs of custom lighting sequences, and download the sequences to the light controller for execution. The application software program provides file handling capability such as open, copy, save, print and contains a screen based editor, which can be used to create lighting display programs. The software program features a high level type of macro type of language, in addition to providing support for the low level lighting commands. The software program contains a library of predetermined sequences with user defined parameters and also has the capability of storing user defined library sequences. The software program contains a simulator mode, which allows the user to debug a custom generated sequence on the PC, without being connected to the light controller. When the PC is connected to the serial interface on the lighting controller using a serial data cable, the software application program downloads the user created program to the controller. The controller can execute lighting sequences either as a standalone device or while attached to the PC.

Yet another aspect of the present invention is to provide a lighting control system, as previously described, that has a non volatile memory, which can store user generated lighting sequences, allowing the controller device to be re-programmed as desired by the user.

Another aspect of the present invention is to provide a lighting control system, that supports single, dual, and triple parallel sequence modes of operation to allow animation and simultaneous multiple scene displays. Animation effects can be created by sequential lighting of multiple stationary profiles, to give the illusion of motion.

The present invention provides the user the capability of programming the sequence selection switch positions to initiate different modes of operation and select among different sequences stored in the non volatile memory.

To minimize the electrical wiring knowledge a user requires, the input power supplied to the controller of the present invention is supplied by a conventional AC power cord, and the output wiring connections utilize standard AC receptacles. An overcurrent protection device is connected in series with one leg of the AC wiring of the control system.

Another aspect of the present invention is the use of a visual indicator for testing the compatibility of a lighting load with the controller individual output circuit power capability.

Another aspect of the present invention is to provide an optional power booster device for the lighting control system, which allows the power from an individual circuit to be increased beyond that available from the main controller, to handle higher current loads like those encountered in commercial lighting displays.

The housing of the present controller is a single outdoor enclosure with AC wiring for connection to an AC power source of sufficient rating to operate the control system and to power the lighting strings. The front panel of the housing contains the Run/Halt and Sequence Select switches, the serial interface connector, and the visual indicators for AC power and Ready/Error conditions.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 11:
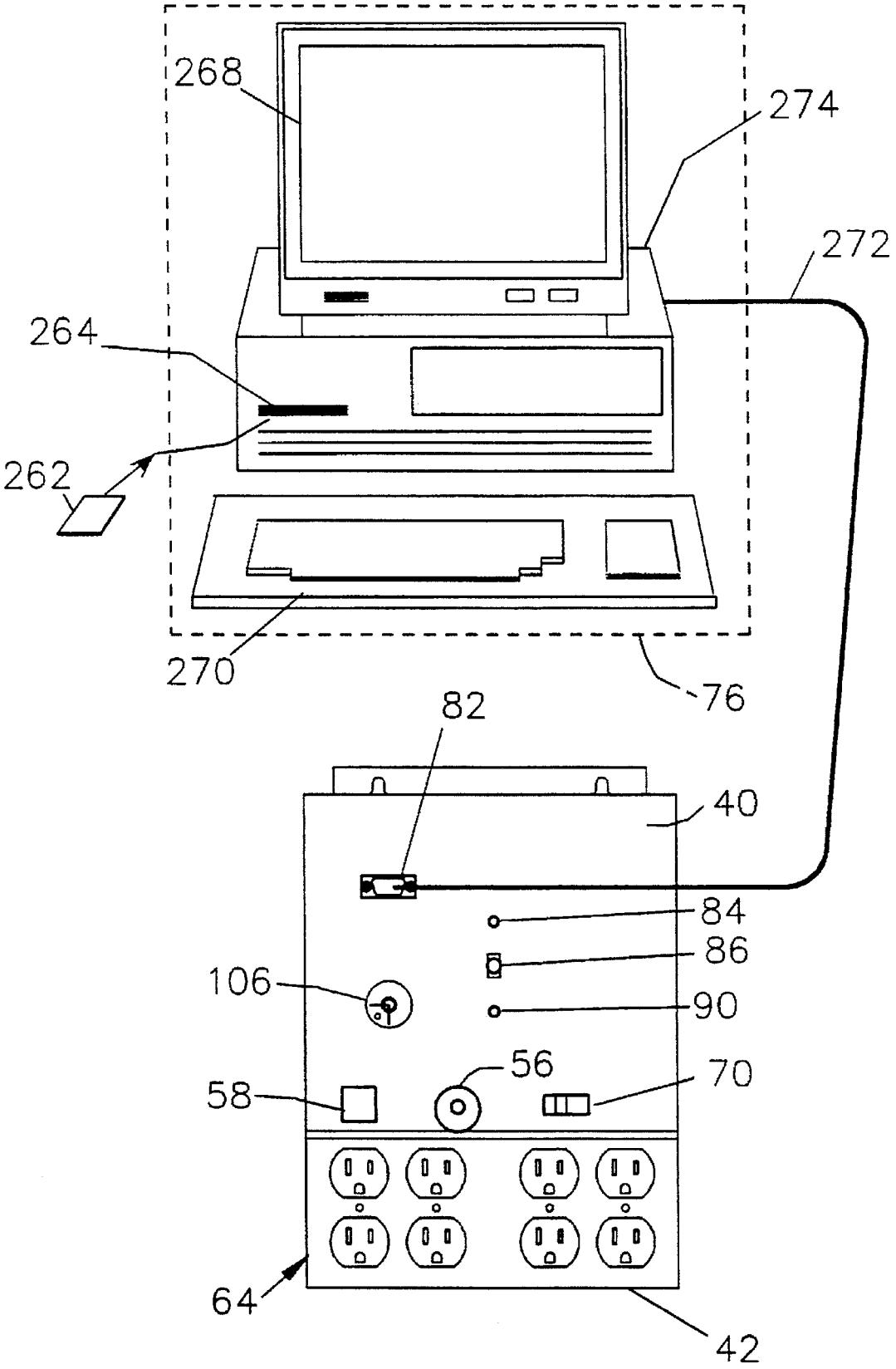
FIG. 11 is an illustration containing a controller download configuration of the present lighting controller.
Figure 16:
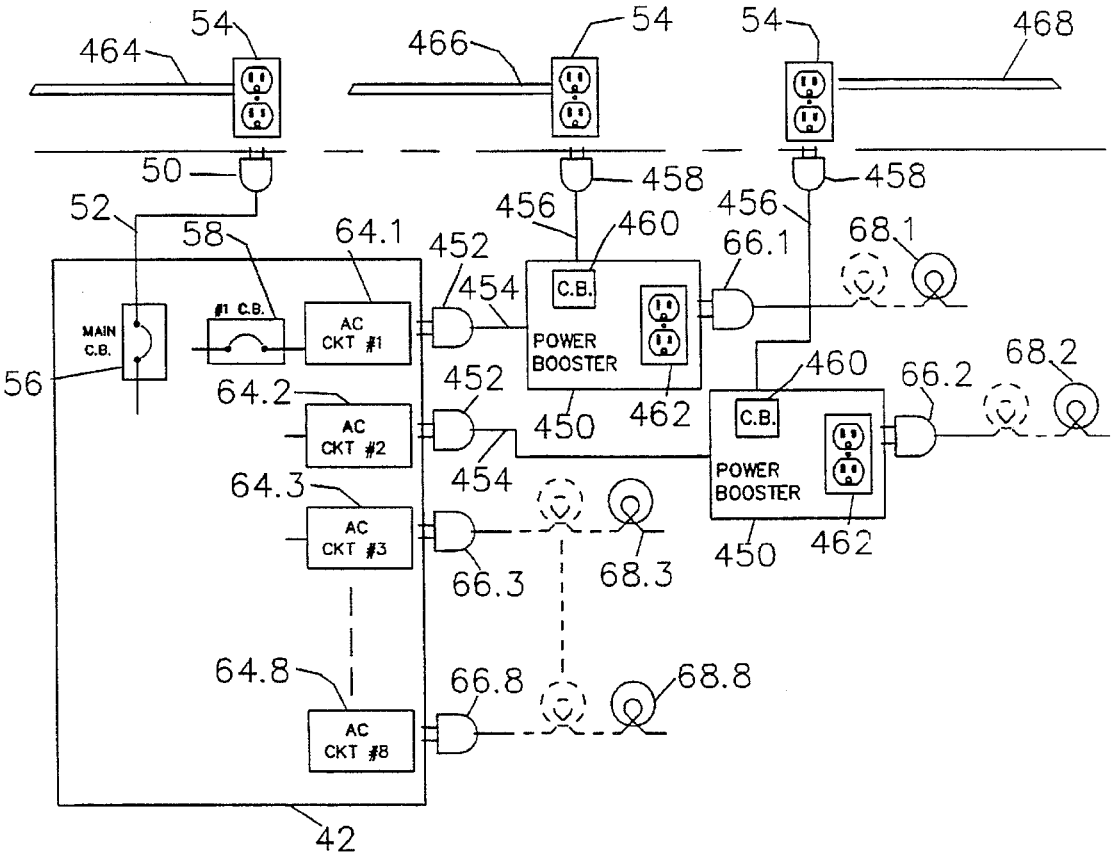
FIG. 16 is a block diagram of the controller and the power booster device configuration of the present invention.

The present invention includes a programmable light controller, a power booster device, and application software required to program a light controller. The various components of this invention are illustrated in FIGS. 1, 11, and 16.

Figure 1:
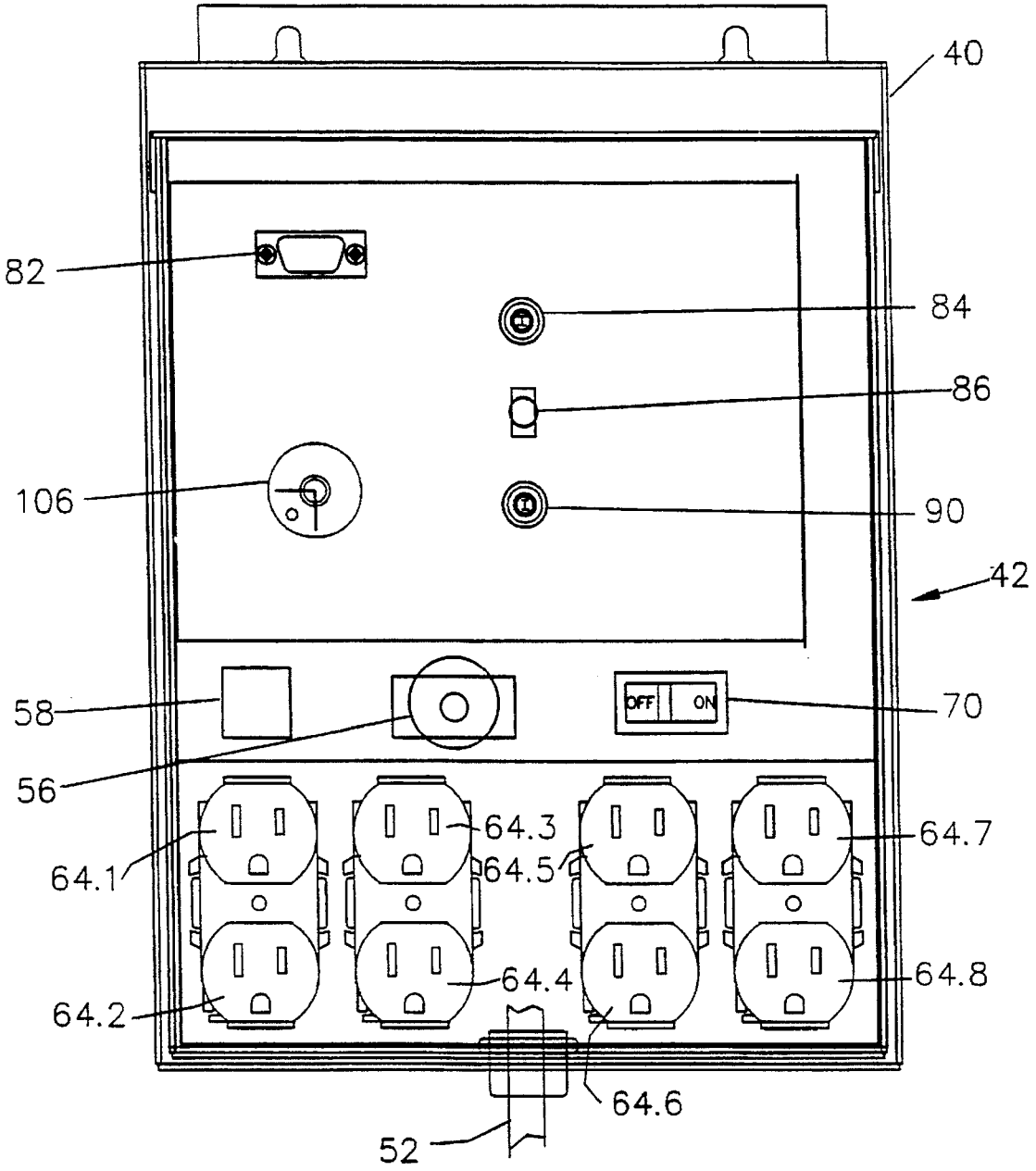
FIG. 1 is an illustration of an enclosure for use with the present lighting controller.

FIG. 1 illustrates an enclosure 40 for the present light controller, generally identified by the numeral 42. Enclosure 40 is configured for both outdoor and indoor use. Integrated configuration packages are also possible, where the main elements of the controller 42 are combined with other devices into a single package for a specific application.

Figure 2:
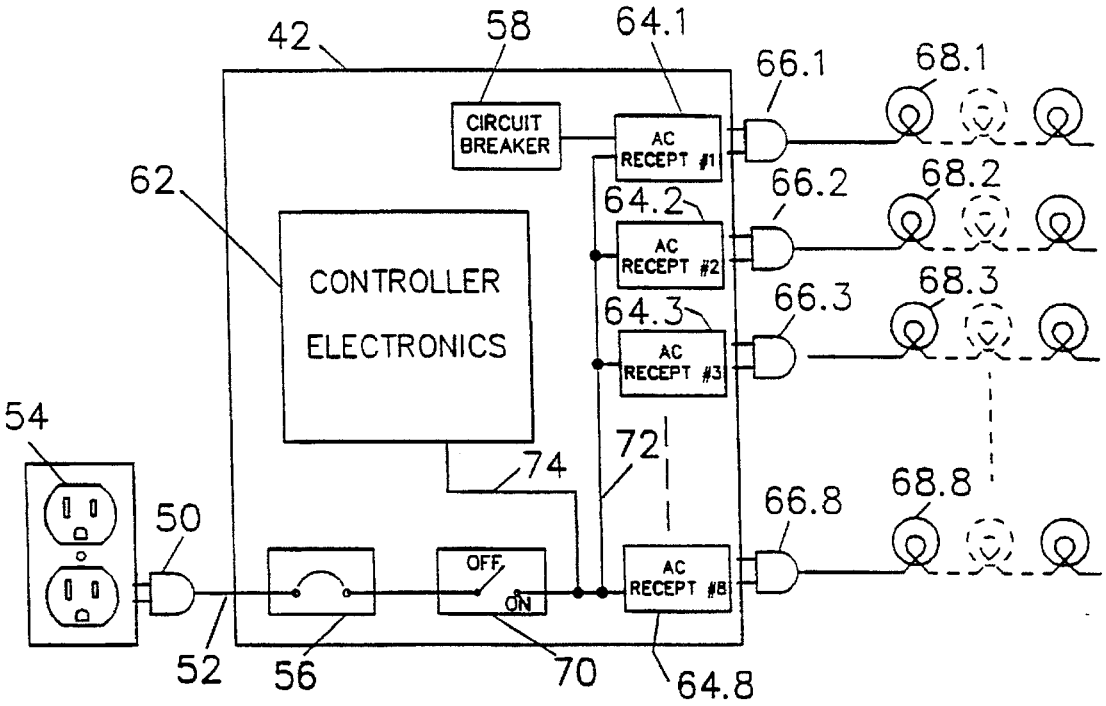
FIG. 2 is a block diagram of a standalone controller configuration of the present lighting controller.

Referring to FIG. 1 and FIG. 2 which is a block diagram of the standalone controller configuration of the present invention. The controller 42 contains an AC power plug 50 which is connected to an AC cord 52 and obtains AC prover via a common household receptacle 54. Circuit breaker 56 provides the main overcurrent protection for the controller 42 and is connected in series with the controller power switch 70. Power switch 70 is connected in series with AC power circuit 72, connected to the AC output receptacles 64.1 thru 64.8 and the AC power circuit 74, connected to the controller electronics 62. A circuit breaker 58 is connected to receptacle 64.1 whose operation will be subsequently described.

The preferred embodiment of the controller 42 contains eight individual and independent AC output circuits via common household AC receptacles 64.1 thru 64.8, and is designed to operate either single light bulbs 68 or strings of lights 68.1 through 68.8, which are either series or parallel connected and plugged into the controller 42 via AC plugs 66.1 thru 66.8 It is understood that fewer than eight or more that eight output circuits and light strings 68 may be used with the present invention, eight circuits being used for illustrative purposes only. Power is supplied to receptacles 64 via a switch 70.

Figure 3:
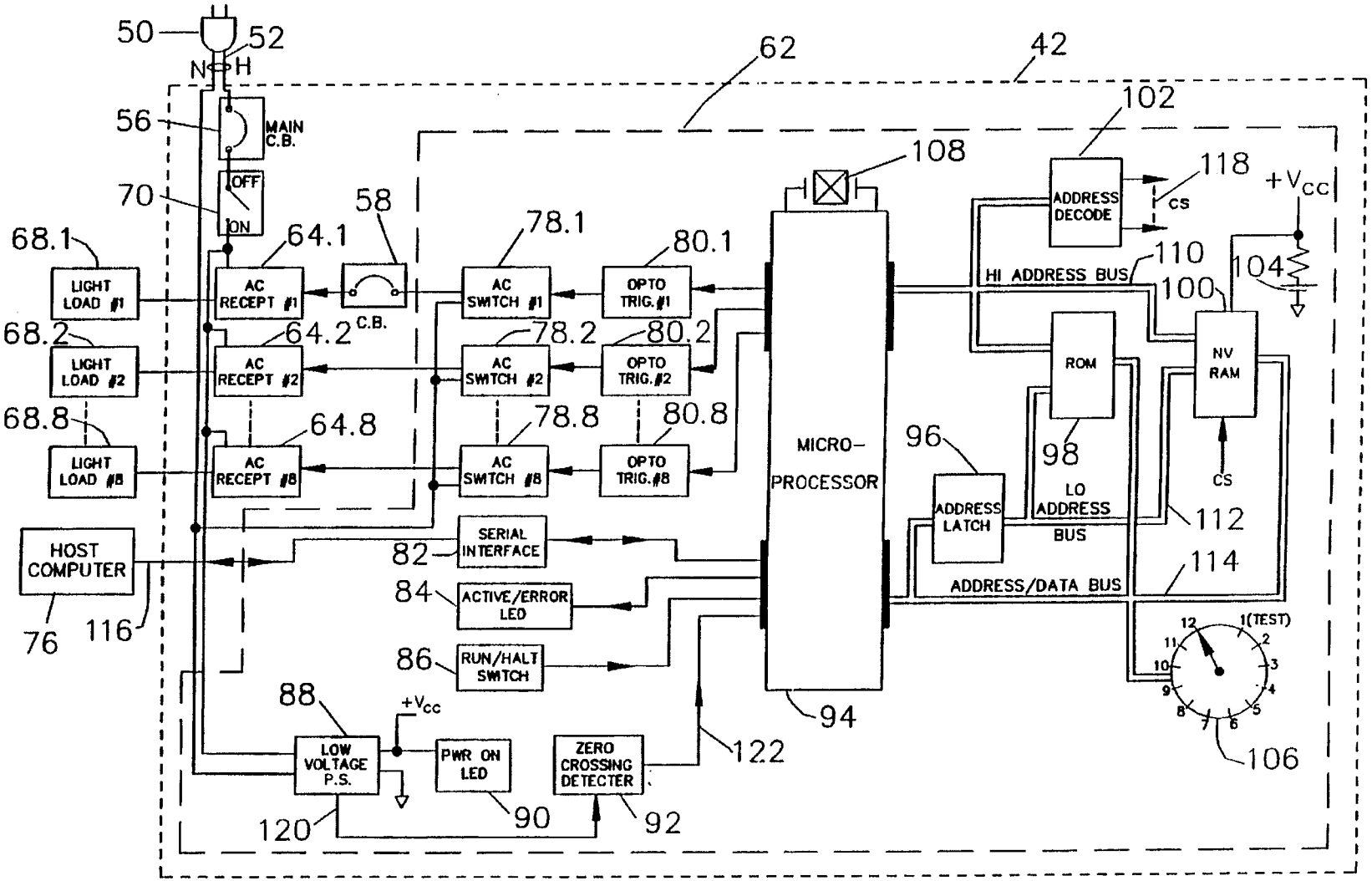
FIG. 3 is a detailed block diagram of the present lighting controller.

Referring to FIGS. 1, 2 and 3, FIG. 3 is a detail electrical block diagram of the light controller 42, which is housed in enclosure 40 of FIG. 1. The microprocessor 94, with crystal oscillator 108, provides all the timing and control functions of the controller electronics 62, which are contained on a printed circuit board. The microprocessor 94 communicates with the host computer 76 via the serial cable 116 and the controller serial interface 82, in order to load user generated lighting sequences into the non volatile memory 100. The memory 100 is powered by a rechargeable battery 104 in the absence of power from the low voltage power supply 88, when AC power is removed by unplugging the AC power plug 50 or turning the controller power switch 70 off.

The microprocessor low order address bus 112 is separated from the multiplexed address/data bus 114 by the address latch 96 and is combined with the high order address bus 110 to control the ROM 98, which stores the firmware executed by the microprocessor 94 and the preprogrammed lighting sequences, and to control the RAM 100, which stores the user generated lighting sequences. The address signals on address bus 110 are decoded by address decoder 102 to provide various chip select signals 118 for the RAM memory 100 and input signal control of the sequence select switch 106.

The power on LED 90 (FIGS. 1 and 3) provides a visible indication that power is applied to the controller 42. The low voltage power supply 88 provides DC power, VCC, for all the logic functions of the controller electronics 62 and also provides a low voltage version of the AC line signal 120 to the zero crossing detector circuit 92, which outputs a pulse 122 to the microprocessor in synchronism with each zero crossing of the AC power line.

The microprocessor 94 provides independent timing control and intensity control to lights 68.1 thru 68.8, connected to AC receptacles 64.1 thru 64.8 via the opto isolated trigger circuits 80.1 thru 80.8, which trigger the AC power switches 78.1 thru 78.8. An important aspect of the present controller 42 is the capability of independent control of both the time duration and the intensity of the lighting state of lights 68 to allow the creation of unique lighting effects. When any one of the AC prover switches 78.1 thru 78.8 is on, the neutral connection to the corresponding AC receptacle 64.1 thru 64.8 is complete and the corresponding lighting load 68.1 thru 68.8 will turn on.

Referring to FIGS. 1 and 3, in addition to the serial interface 82, the microprocessor 94 also supports the other control panel functions, which consist of the Run/Halt switch 86, the Active/Error LED 84 and the twelve position rotary sequence select switch 106.

The user may not know or be able to easily calculate the power requirement of an individual lighting load that the user wishes to use with the light controller 42. The light controller 42 contains a special test mode for the user to check that the power requirement of the light loads 68.1 thru 68.8 does not exceed the prover that the controller 42 can reliably deliver to the individual AC output receptacles 64.1 thru 64.8. The test mode is activated, when the Run/Halt switch 86 is in the halt mode, and the sequence select switch 106 is in a test position. In response to these settings, the controller firmware will turn on AC switch 78.1 and power will be supplied through a circuit breaker 58 to AC receptacle 64.1. By plugging any one of the light loads 68.1 thru 68.8 into AC receptacle, when the special test mode is active, the user can determine the compatibility of that light load using a visual indicator contained on the circuit breaker 58.

Figure 4:
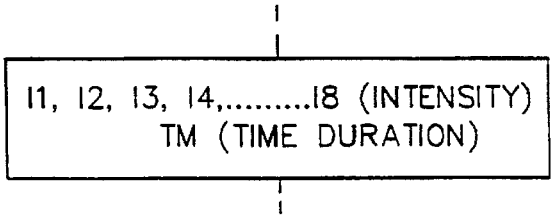
FIG. 4 is an illustration containing the definition of a lighting state.
Figure 5:
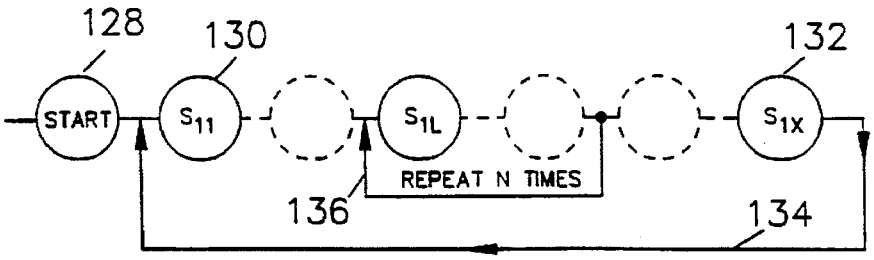
FIG. 5 is an illustration of an example of a single lighting sequence.
Figure 6:
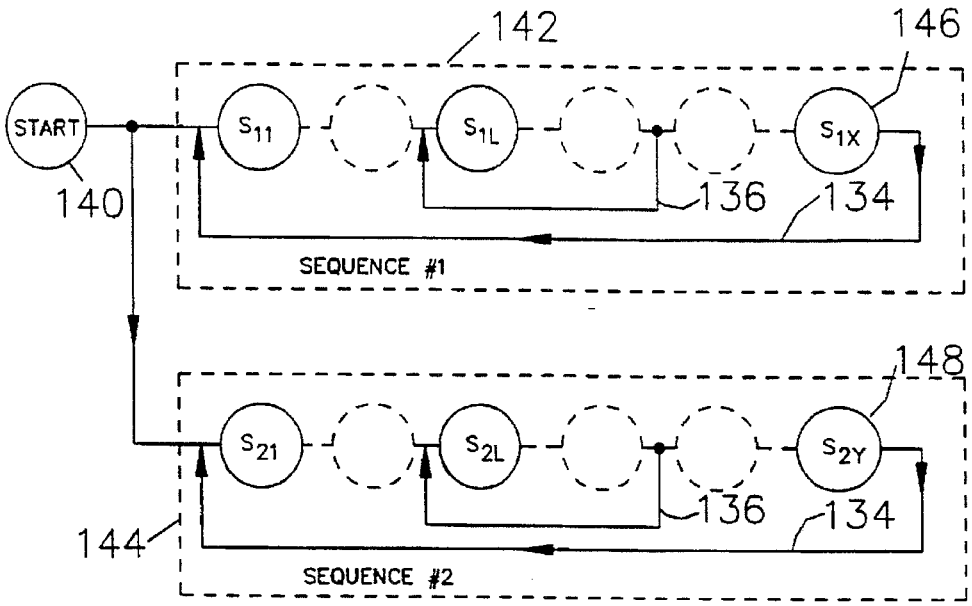
FIG. 6 is an illustration of an example of a dual parallel lighting sequence.
Figure 7:
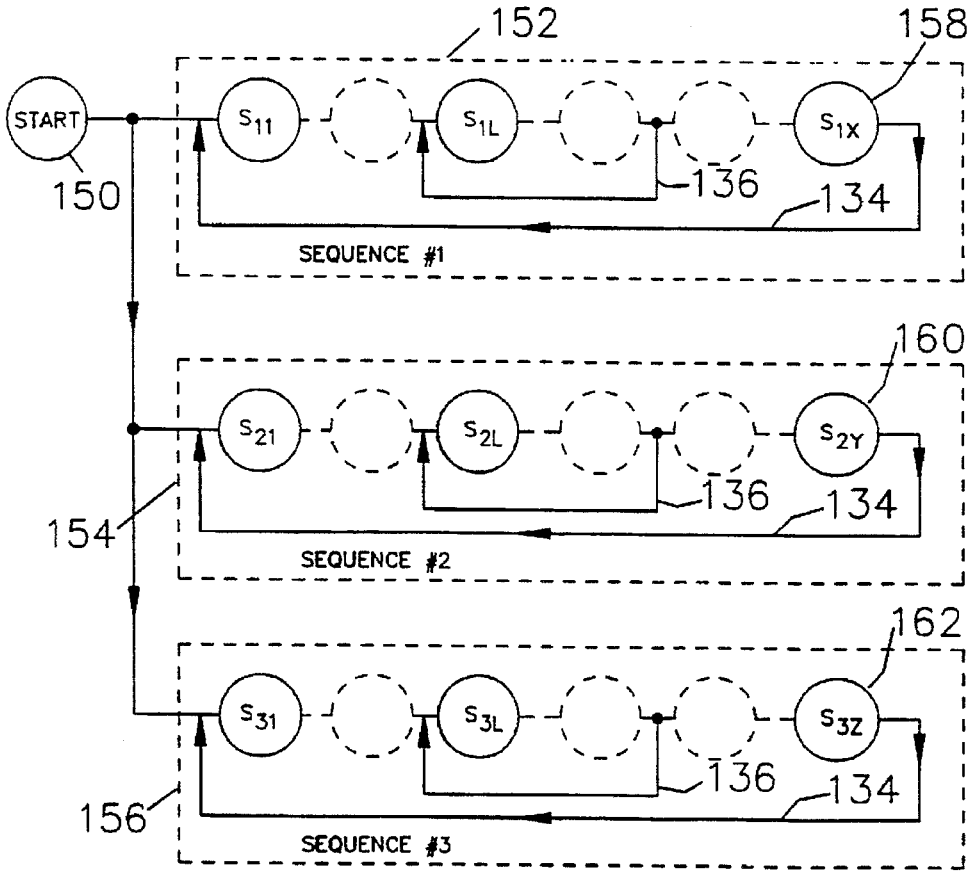
FIG. 7 is an illustration of an example of a triple parallel lighting sequence.

FIG. 4 illustrates the parameters of a lighting state and FIGS. 5 thru 7 are examples of various lighting sequences, which will be used to describe the operation of the lighting controller 42.

The notations I1 thru I8 used in FIG. 4 represent the lighting intensity, as a percentage of full on, of the eight AC circuits available at the AC receptacles 64.1 thru 64.8. The individual values of I1 thru I8 range from 100,90, . . . 10,0 percent of full on intensity. 100 percent indicates the intensity of lights 68 is full on, while 0 percent indicates the intensity of lights 68 is full off. The notation TM, shown in FIG. 4, represents the time duration of the lighting state in seconds. For the preferred embodiment the TM values ranges from 0.008 seconds to 9.0 minutes.

The present controller 42 is capable of controlling a single lighting sequence 128 as illustrated in FIG. 5, which is made up of a series of multiple independent lighting states 130 thru 132, of intensity and time. Sequence 128 may contain multiple internal sequence loops 136, in addition to the main sequence repeat loop 134. For a given single sequence 128, the number of AC receptacles 64.1 thru 64.8 used is constant and could range from one to all eight of the available circuits. Referring to FIG. 5, the controller 42 can be programmed to repeat an internal loop 136 a variable N number of times, where N can range from 1 to 65,500. In FIG. 5, the number of lighting states within a sequence 132 is variable and limited by the size of the controller RAM memory 100.

The present invention allows the user the capability of creating two independent lighting sequences 128 or lighting scenes separately, which the controller 42 executes simultaneously. This feature of a dual parallel lighting sequence 140, is illustrated in FIG. 6. The time duration and the intensity parameters of the states 146 of a first sequence 142 can differ from those of the states 148 of a second sequence 144. The number of states 146 of sequence 142 can differ from the number of states 148 of sequence 144. The light circuits included in sequence 142 will in general be different from the light circuits included in sequence 144. The possible combinations of the two independent circuit groups for a dual parallel sequence with eight circuits using the notation: # of circuits in first sequence/# of circuits in second sequence, would be: 7/1, 6/2, 5/3, or 4/4.

The present invention allows the user the capability of creating three independent lighting sequences 128 or lighting scenes separately, which the controller executes simultaneously. This feature of controlling a triple parallel lighting sequence 150 is illustrated in FIG. 7. The time duration and intensity parameters of the states of first sequence 152, second sequence 154, and third sequence 156 can all be different. The number of states, 158, 160 and 162 of sequences 152, 154, and 156, respectively, can all be different. The possible combinations of the three independent circuit groups for a triple parallel sequence with eight circuits using the notation: # of circuits in first sequence/# of circuits in second sequence/# of circuits in third sequence, would be: 4/2/2, 3/3/2, 4/3/1 or 6/1/1.

Referring to FIG. 3, the controller 42 contains a twelve position rotary selection switch 106 to allow the user to select either pre-programmed lighting sequences, which are stored in ROM 98, or user created custom lighting sequences, which are stored in non volatile RAM 100. The preferred embodiment utilizes five positions (positions 1 thru 5) of the sequence selection switch 106 to select preprogrammed ROM sequences and seven positions (positions 6 thru 12) of the sequence selection switch 106 to select user created custom RAM sequences. The preferred embodiment contains seventeen memory areas in the non volatile RAM 100, in which the user can store up to seventeen independent custom generated lighting sequences. The mode of operation for the controller 42 refers to the execution mode of either a single 128, dual parallel 140, or triple parallel 150 sequence. The assignment of the seven sequence select switch positions 6 thru 12 to the seventeen RAM sequences locations and the mode of operation of the controller, is programmable by the user.

Table 1 is an illustration of the programmable map feature of the sequence select switch 106. Referring to Table 1, the first five switch positions of switch 106 can activate seven (1 thru 7) different ROM 98 sequences, where switch positions 1 thru 3 are devoted to three preprogrammed single sequences, while switch position 4 and switch position 5 are each devoted to dual parallel sequences. Table 1 shows that the seven switch positions of switch 106 numbered 6 thru 12 are programmable by the user to active one, two, or three sequences simultaneously, of the seventeen (8 thru 24) user generated RAM 100 sequences, corresponding to a single, dual parallel, or triple parallel sequence The sequences shown in Table 1 are for illustrative purposes only, it being understood that numerous other map features may be used with the present controller 42. The use of a twelve position selection switch is also for illustrative purposes, it being understood that fewer or more than twelve positions may be utilized with the present controller 42, depending on the size of memory 98 and memory 100 and the number features desired.

TABLE 1

ILLUSTRATION OF SELECTION SWITCH MAP FEATURE

| SWITCH # | SEQUENCE # | MODE | MEMORY TYPE |
|---|---|---|---|
| 1 | 1 | SINGLE SEQUENCE | |
| 2 | 2 | SINGLE SEQUENCE | ↑ |
| 3 | 3 | SINGLE SEQUENCE | 7 ROM |
| 4 | 4,5 | DUAL SEQUENCE | SEQ. |
| 5 | 6,7 | DUAL SEQUENCE | ↓ |
| 6 | 8 → 24, 8 → 24, 8 → 24 | SINGLE, DUAL, OR TRIPLE SEQ. | |
| 7 | 8 → 24, 8 → 24, 8 → 24 | SINGLE, DUAL, OR TRIPLE SEQ. | ↑ |
| 8 | 8 → 24, 8 → 24, 8 → 24 | SINGLE, DUAL, OR TRIPLE SEQ. | 17 RAM |
| 9 | 8 → 24, 8 → 24, 8 → 24 | SINGLE, DUAL, OR TRIPLE SEQ. | SEQ. |
| 10 | 8 → 24, 8 → 24, 8 → 24 | SINGLE. DUAL, OR TRIPLE SEQ. | ↓ |
| 11 | 8 → 24, 8 → 24, 8 → 24 | SINGLE, DUAL, OR TRIPLE SEQ. | |
| 12 | 8 → 24, 8 → 24, 8 → 24 | SINGLE, DUAL, OR TRIPLE SEQ. | |

The illustrated controller 42 has eight independent AC circuits and controls the intensity of each individual light circuit 68 by varying the conduction angle of the applied AC line voltage to the light circuit. Referring to FIG. 3, the microprocessor 94 receives a zero crossing pulse 122, which marks the zero crossing of the AC line voltage.

Table 2 will be used to describe the method by which the microprocessor firmware implements the individual light circuit 68 intensity control function. The zero crossing pulse 122, is used by the microprocessor 94 to start an intensity timer and an intensity counter, which are used to divide the half cycle time, 8.33 mS, of the input power AC waveform into 16 time slots of 0.5 m each. Each of the time slots, 1 thru 17, is assigned an active power level, as shown in Table 2. The power level number is also used by the application software program to indicate the desired individual circuit intensity level for each lighting state of the sequence. The power level number has a range from 15 to 0, where 15 indicates full on intensity, and 0 indicates full off intensity. The microprocessor firmware compares the active power level at each time slot with the lighting state power level requested by the application program and when equal turns on the appropriate AC power switch 78.1 thru 78.8.

TABLE 2

INTENSITY CONTROL IMPLEMENTATION

| $^{T}$DELAY (MSEC) | TIME SLOT # | POWER LEVEL | POWER (%) |
|---|---|---|---|
| 0.0 → 0.5 | 1 | 15 | 100.0 |
| >0.5 → 1.0 | 2 | 15 | 100.0 |
| >1.0 → 1.5 | 3 | 14 | 98.9 |
| >1.5 → 2.0 | 4 | 13 | 96.4 |

TABLE 2-continued

INTENSITY CONTROL IMPLEMENTATION

| $^{T}$DELAY (MSEC) | TIME SLOT # | POWER LEVEL | POWER (%) |
|---|---|---|---|
| >2.0 → 2.5 | 5 | 12 | 91.9 |
| >2.5 → 3.0 | 6 | 11 | 85.1 |
| >3.0 → 3.5 | 7 | 10 | 76.2 |
| >3.5 → 4.0 | 8 | 9 | 65.6 |
| >4.0 → 4.5 | 9 | 8 | 54.0 |
| >4.5 → 5.0 | 10 | 7 | 42.0 |

TABLE 2-continued

INTENSITY CONTROL IMPLEMENTATION

| $^{T}$DELAY (MSEC) | TIME SLOT # | POWER LEVEL | POWER (%) |
|---|---|---|---|
| >5.0 → 5.5 | 11 | 6 | 30.6 |
| >5.5 → 6.0 | 12 | 5 | 20.5 |
| >6.0 → 6.5 | 13 | 4 | 12.3 |
| >6.5 → 7.0 | 14 | 3 | 6.3 |
| >7.0 → 7.5 | 15 | 3 | 6.3 |
| >7.5 → 8.0 | 16 | 3 | 6.3 |
| >8.0 → 8.33 | 17 | 0 | 0.0 |

Figure 8:
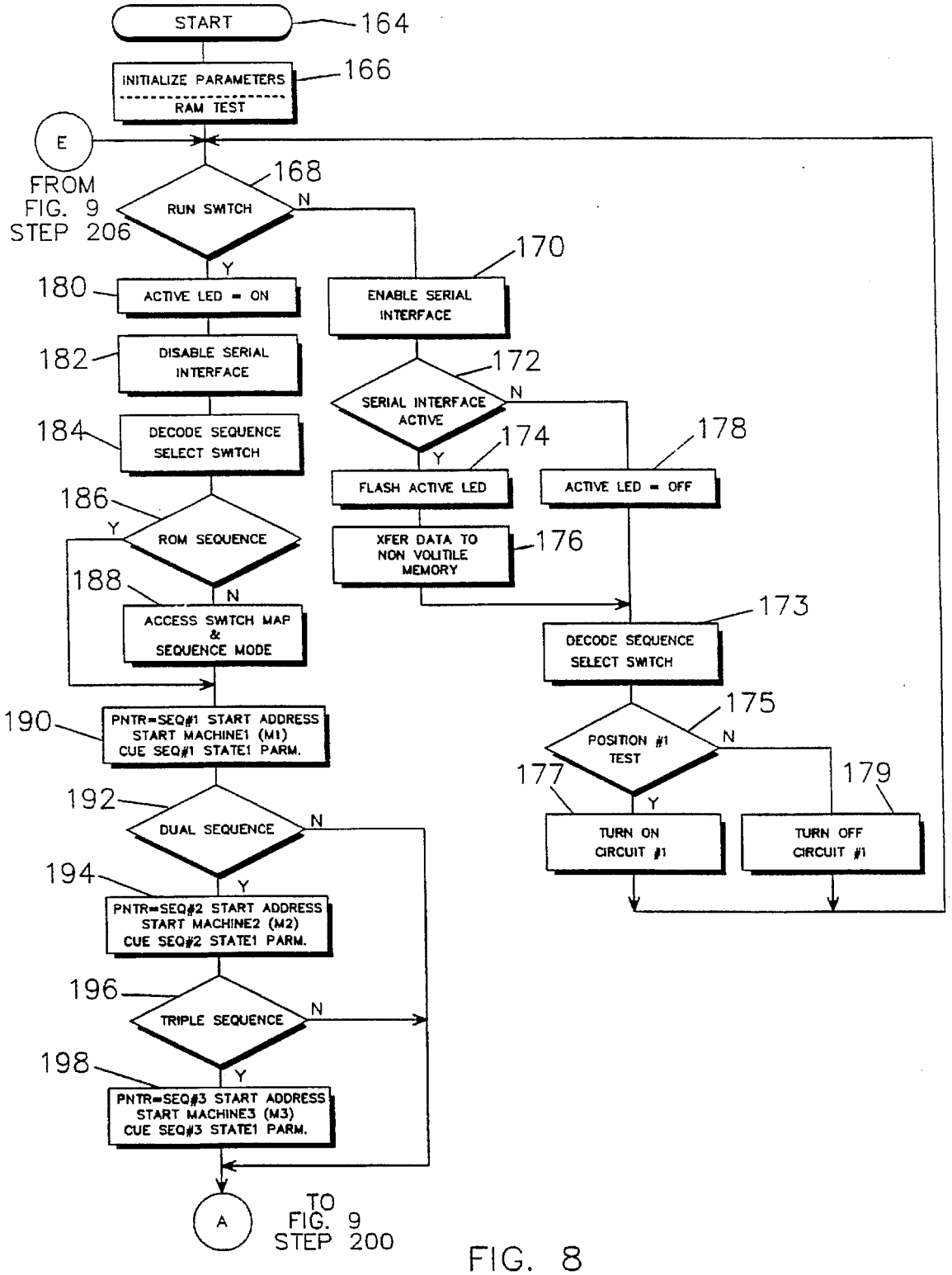
FIGS. 8–10 are computer flow diagrams illustrating the operation of the present lighting controller.
Figure 9:
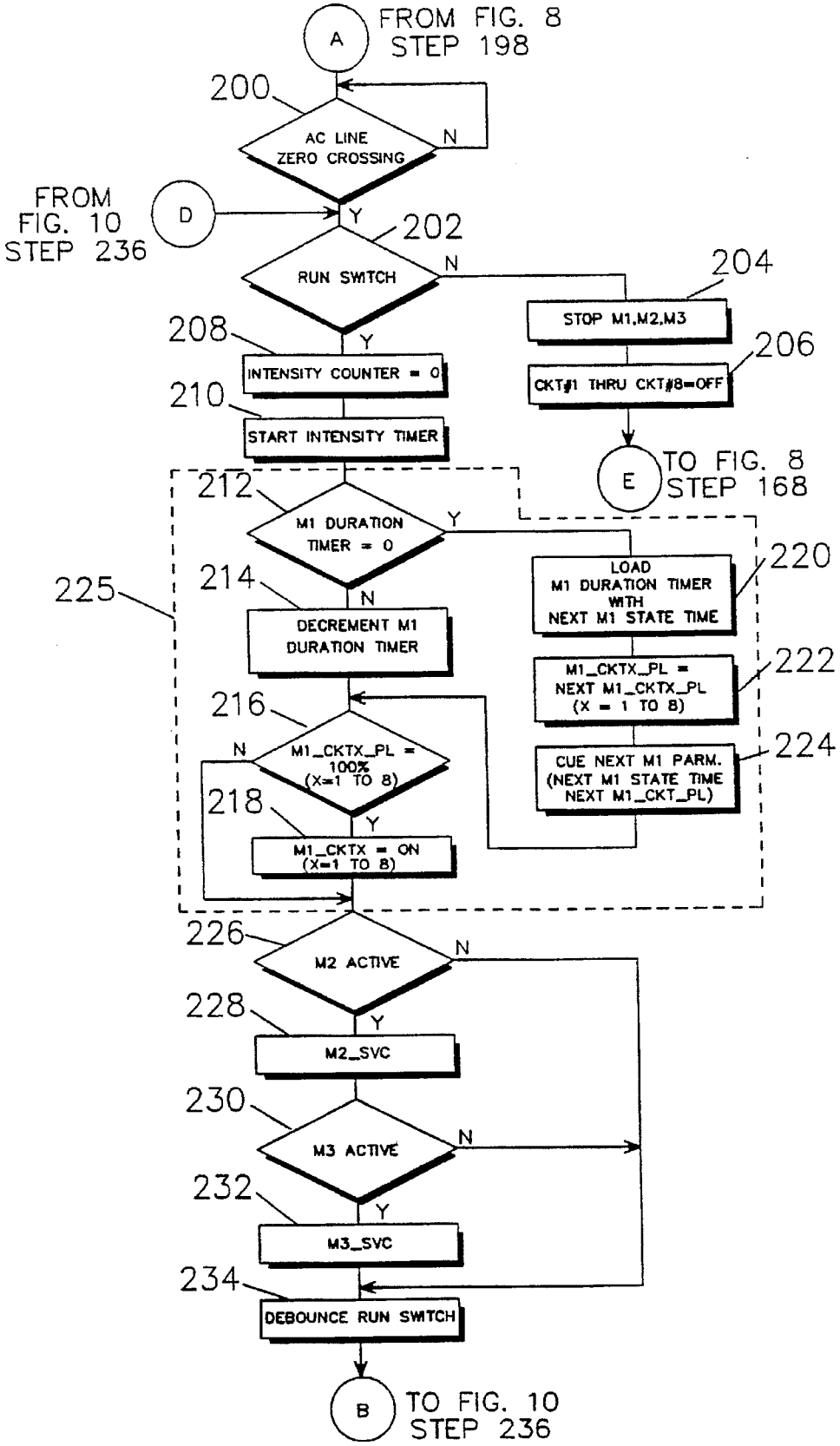
Figure 10:
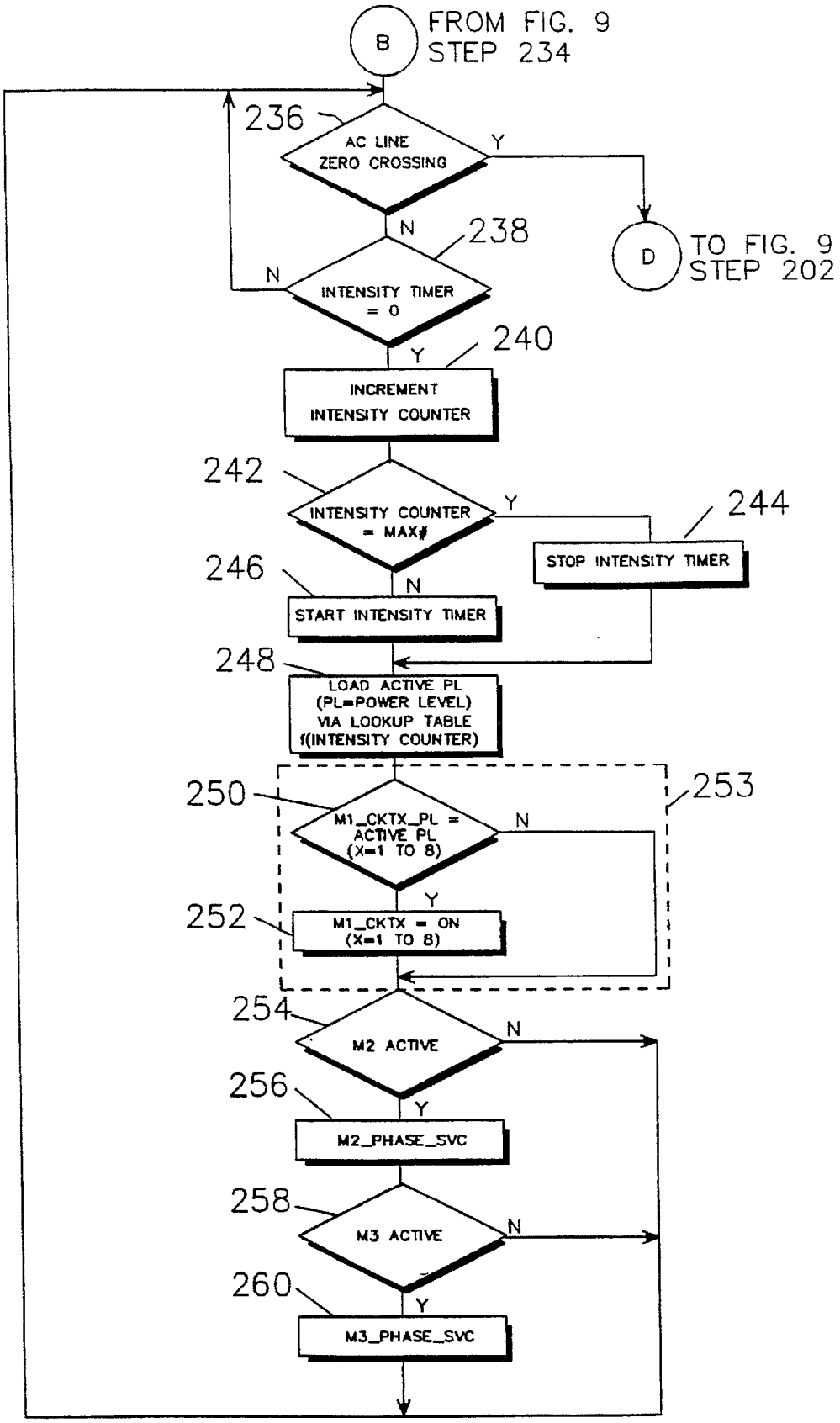

The detail functional flow diagram of the controller 42 firmware is contained in FIG. 8, 9, and 10. Referring to FIG. 8, the firmware program starts at step 164 upon application of power. At step 166 the firmware initializes the internal output ports, internal timers, various program parameters and performs a test of the internal RAM.

At step 168 the RUN/HALT switch 86 is checked to see if it is active. If active, control passes to step 180. If not active, control goes to step 170. At step 170 the serial interface 82 is enabled. At step 172 the firmware checks to see if the serial interface 82 is active. If active, control passes to step 174, where the active LED 84 is flashed. At step 176 the data received from the HOST computer 76 via the serial interface 82 is transferred to the non volatile memory 100, and control passes to step 173. At step 172 if the serial interface 82 is not active, control passes to step 178, where the active LED is turned off and control passes to step 173.

The sequence select switch 106 is decoded at step 173, to see if the AC load test mode is requested. At step 175 a check is made to see if the sequence select switch 106 is at TEST position. If TEST position is selected, control passes to step 177. If TEST position is not selected, control passes to step 179. At step 177 AC receptacle 64.1 is turned ON and control passes back to step 168. At step 179, AC receptacle 64.1 is turned OFF and control passes back to step 168.

At step 168 with the RUN/HALT switch 86 active, control passes to step 180, where the active LED 84 is turned ON. At step 182 the serial interface 82 is disabled. The sequence select switch 106 is decoded at step 184. The firmware checks the sequence select switch position at step 186 and determines if a ROM or RAM sequence has been selected. If a ROM 98 sequence is selected the control passes to step 190, along with the sequence starting addresses. If a RAM 100 sequence has been selected, control passes to step 188. At step 188 the firmware accesses the switch map location in non volatile memory 100 and determines the operation mode, which has been programmed for the selected switch position, along with the starting addresses of the corresponding sequences. The operation mode refers to either one, two, or three sequences operating simultaneously.

At step 190 the firmware loads a pointer to the starting address of the first lighting sequence, cues the lighting state parameters, intensity and time duration, for the first state of the first sequence, and enables the first firmware sequencer (M1). At step 192 a check is made to see if a dual sequence was selected. If a dual sequence was selected, control is passed to step 194. If a dual sequence was not selected, control is passed to step 200 of FIG. 9. At step 194 the firmware loads a pointer to the starting address of the second lighting sequence, cues the lighting state parameters for the first state of the second sequence, and enables the second firmware sequencer (M2). At step 196 a check is made to see if a triple sequence was selected. If a triple sequence was selected, control is passed to step 198. If a triple sequence was not selected, control is passed to step 200 of FIG. 9. At step 198 the firmware loads a pointer to the starting address of the third sequence, cues the lighting state parameters for the first state of the third sequence, and enables the third firmware sequencer (M3), control is then passed to step 200 in FIG. 9.

Referring to FIG. 9, the firmware waits for the microprocessor 94 to receive a zero crossing pulse 122 at step 200. Once a zero crossing pulse occurs control passes to step 202. At step 202 the RUN\HALT switch 86 is checked to see if it is active. If active, control passes to step 208. If not active, control goes to step 204. At step 204 the firmware sequencers M1, M2, and M3 are stopped. At step 206 the AC switches 78.1 thru 78.8 are turned off, and control is returned to step 168 in FIG. 8. At step 208 the intensity counter is cleared. At step 210 the 0.5 mS intensity timer is started.

At step 212 the M1 duration timer, which contains the time of the active state of the first sequencer (M1) is checked for zero. If the M1 duration timer is zero, control goes to step 220. If the M1 duration timer is not zero, control passes to step 214. At step 220 the M1 duration timer is reloaded with the duration time of the next state of the first sequence, denoted as Next M1 State Time. At step 222 the memory register locations, which contain the M1 active intensity values, denoted as M1_CKTX_PL, are reloaded with the intensity values of the next state of the first sequence, denoted as NXT M1_CKTX_PL. At step 224 the next M1 light state parameters are re-cued, the Next M1 State Time value and the M1_CKTX_PL values are reloaded, in order to maintain the cue registers one state ahead of the M1 active sequence state. Control is then passed to step 216.

At step 214 the M1 duration timer is decremented. At step 216 the firmware checks to see if any of the active M1 state intensity values, denoted as M1_CKTX_PL, are equal to 100 percent, which is a full on condition. If any of the members of M1_CKTX_PL are equal to 100 percent, control goes to step 218. If M1_CKTX_PL are not equal to 100 percent, control goes to step 226. At step 218 the firmware turns on the AC switches 78.1 thru 78.8, which had corresponding values in M1_CKTX_PL equal to 100 percent at step 216. The steps 212 thru 224 together represent the M1 sequence service routine 225, denoted M1_SVC.

At step 226 the firmware checks to see if the M2 firmware sequencer is active. If M2 is active, control goes to step 228. If M2 is not active, control goes to step 234. Step 228 is similar to routine 225, with M1 replaced by M2.

At step 230 the firmware checks to see if the M3 firmware sequencer is active. If M3 is active, control goes to step 232. If M3 is not active, control goes to step 234. Step 232 is similar to routine 225, with M1 replaced by M3.

At step 234 the firmware preforms a debounce function on the input signal from the RUN/HALT switch 86 to eliminate contact bounce. Control passes to step 236 in FIG. 10.

Referring to FIG. 10 step 236, the firmware checks to see if the microprocessor 94 has received a zero crossing pulse 122. If a zero crossing pulse occurred, control passes to step 202 in FIG. 9. If a zero crossing pulse has not occurred, control passes to step 238. At step 238 the firmware checks the intensity timer for zero. If zero, control passes to step 240. If not zero, control passes to step 236. At step 240 the intensity counter is incremented.

At step 242 the firmware checks to see if the intensity counter is at the maximum count equal to seventeen. If the counter is at the maximum, control goes to step 244. If not at the maximum, control goes to step 246, where the 0.5 mS intensity timer is started. At step 244 the intensity timer is stopped and control passes to step 248.

At step 248 the value of the intensity counter is utilized to access a firmware lookup table to determine the active power level.

At step 250 the firmware checks the active M1 state intensity levels, denoted M1_CKTX_PL, to see if any are equal to the active power level obtained from the lookup table. If equal, control passes to step 252. If not equal, control passes to step 254. At step 252 the firmware turns on the AC switches 78.1 thru 78.8, which had corresponding values in M1_CKTX_PL equal to the active power level at step 250. The steps 250 thru 252 together represent the M1 phase service routine 253, denoted M1_PHASE_SVC.

At step 254 the firmware checks to see if the M2 firmware sequencer is active. If M2 is active, control goes to step 256. If M2 is not active, control goes to step 236. Step 256 is similar to routine 253, with M1 replaced by M2.

At step 258 the firmware checks to see if the M3 firmware sequencer is active. If M3 is active, control goes to step 260. If M3 is not active, control goes to step 236. Step 260 is similar to routine 253, with M1 replaced by M3.

Referring to FIG. 11, the controller 42 application software is contained on a floppy disk 262 and can be installed on a host computer 76, such as, for example, a personal computer containing a floppy disk drive 264, a keyboard 270, a serial interface 274, and a CRT display 268. With the application software active, the personal computer 76 becomes a tool by which the user can create unique custom lighting sequences.

Table 3 contains an overview of the main features of the present application software. The details of the application software are contained in the flow diagrams contained in FIGS. 12 thru 15. The application program enables the user to create custom lighting sequences on the PC.

TABLE 3

| SUMMARY OF APPLICATION SOFTWARE FEATURES |
|---|
| 1) FILE OPERATIONS: Open, Save, Print, Quit |
| 2) SCREEN BASED SEQUENCE EDITOR |
| LINE OPERATIONS |
| BLOCK OPERATIONS: Move, Copy, Delete |
| 3) LIBRARY OPERATIONS |
| PREPROGRAMMED MACRO SEQUENCES |
| (user defined parameters) |
| USER CREATED SEQUENCES |
| 4) OPTIONS |
| OPERATOR PREFERENCE ITEMS |
| 5) SIMULATION MODE |
| VISUAL SIMULATION of SEQUENCE |
| CONTROLS: Run/Stop,Pause,Single Step |
| SEQUENCE TRACKING |
| 6) CONTROLLER INTERFACE |
| DOWNLOAD FILE |
| READ SWITCH MAP |
| 7) PROGRAMMING FORM |
| FIELD SENSITIVE |
| MEMORIZED ITEMS |

fied by the user; LABEL represents the user specified label name for a program line; LOOPNAME is the label name for the start of a subroutine; CNT represents the number of counts the loop will execute and SEQ# is the number of the sequence. The allotted memory size for an individual sequence, within the non-volatile RAM 100, can be effectively increased by utilizing the long jump and the long call operation codes.

The command codes shown are utilized to define the memory storage location in non volatile memory 100 and to define the sequence switch map. Examples of the command codes are shown in Table 4, where the numbers shown in () are user specified parameters. The notation shown in Table 4 is as follows: SW# is the position of the sequence select switch 106 (6 thru 12); SEQ1# is the number of the first sequence, SEQ2# is the number of the second sequence, SEQ#3 is the number of the third sequence (8 thru 24).

TABLE 4

| EXAMPLE of USER PROGRAMMING COMMANDS | |
|---|---|
| EXAMPLE of OPERATION CODES: | |
| CMAP(I1,I2,I3,I4,I5,I6,I7,I8,TM) | Circuit Map |
| CON(TM) | All Circuits On |
| COFF(TM) | All Circuits Off |
| JMP(LABEL) | Jump To Label in Present Sequence |
| LJMP(SEQ#,LABEL) | Jump To Label in Different Sequence |
| CALL(LOOPNAME,CNT) | Call Subroutine in Same Sequence With Loop Count |
| LCALL(SEQ#,LOOPNAME,CNT) | Call Subroutine in Different Sequence With Loop Count |
| RET | Subroutine End |
| EXAMPLE of COMMAND CODES: | |
| BGNS(SEQ#) | Begin Sequence Number |
| ENDS(SEQ#) | End Sequence Number |
| SMAP(SW#,SEQ#) | Map SW# to Single Sequence |
| DMAP(SW#,SEQ1#,SEQ2#) | Map SW# to Dual Sequence |
| TMAP(SW#,SEQ1#,SEQ2#,SEQ3#) | Map SW# to Triple Sequence |

Table 4 contains an overview of the lighting controller 42 program language which contains both operation codes and command codes for lighting controller 42. The operation codes are utilized to program the desired custom lighting sequence. Examples of the operation codes are shown in Table 4, where the numbers shown () are user specified parameters. The notation shown in Table 4 is as follows: I1, I2, . . . represents the intensity of circuit #1, circuit #2, etc.; TM represents the time duration of the lighting state, speci- Table 5 illustrates the programming form, which appears on the display 268 of the personal computer 76, during the creation or editing process of a user generated sequence. The programming form is field sensitive, where Labels, and OPCODES etc. must appear in certain columns. Certain columns such as the OPCODE column, feature a memorized item format, generally require only the first two letters of the text to be entered by the user before the program recognizes the entry.

TABLE 5

EXAMPLE OF DISPLAY PROGRAMMING FORM

| LABEL | OPCODE | PARAMETERS | COMMENTS |
|---|---|---|---|
| ----- | ----- | ---------- | ---------- |
| ----- | ----- | ---------- | ---------- |
| ----- | ----- | ---------- | ---------- |
| ----- | ----- | ---------- | ---------- |

TABLE 5-continued

| EXAMPLE OF DISPLAY PROGRAMMING FORM | | | |
|---|---|---|---|
| LABEL | OPCODE | PARAMETERS | COMMENTS |
| ----- | ----- | ---------- | ---------- |
| ----- | ----- | ---------- | ---------- |
| ----- | ----- | ---------- | ---------- |
| ----- | ----- | ---------- | ---------- |
| ----- | ----- | ---------- | ---------- |
| ----- | ----- | ---------- | ---------- |
| ----- | ----- | ---------- | ---------- |

TABLE 6

| EXAMPLE OF USER CREATED SEQUENCE | | | |
|---|---|---|---|
| LABEL | OPCODE | PARAMETERS | COMMENTS |
| | BGNS | 10 | BEGIN SEQUENCE #10 |
| TOP | CALL | FLASH1,4 | Call Subroutine FLASH1, 4 Times |
| | CALL | LOOP1,10 | Call Subroutine LOOP1, 10 Times |
| | CALL | FLASH1,8 | Call Subroutine FLASH1, 8 Times |
| | CALL | LOOP2,20 | Call Subroutine LOOP2, 20 Times |
| | JMP | TOP | Jump to TOP |
| FLASH1 | CMAP | 100,100,100,100,0,0,0,0,0,2 | CIRCUIT MAP COMMAND |
| | COFF | 0,4 | ALL CIRCUITS OFF COMMAND |
| | RET | | SUBROUTINE END COMMAND |
| LOOP1 | CMAP | 100,0,0,0,0,0,0,0,0,2 | CIRCUIT MAP COMMAND |
| | CMAP | 0,100,0,0,0,0,0,0,0,2 | |
| | CMAP | 0,0,100,0,0,0,0,0,0,2 | |
| | CMAP | 0,0,0,100,0,0,0,0,0,2 | |
| | RET | | |
| LOOP2 | CMAP | 0,0,0,100,0,0,0,0,0,2 | CIRCUIT MAP COMMAND |
| | CMAP | 0,0,100,0,0,0,0,0,0,2 | |
| | CMAP | 0,100,0,0,0,0,0,0,0,2 | |
| | CMAP | 100,0,0,0,0,0,0,0,0,2 | |
| | RET | | |
| | ENDS | 10 | END SEQUENCE #10 |

The application program contains a preprogrammed library, which contains Macro sequences. The user can create custom sequences more efficiently by utilizing Macro sequences, which are common sequences the user can customize by specifying specific generic parameters, instead of entering each line of the program code.

Table 7 contains two examples of Macro sequences, and also shows the general format structure. The notation used in Table 7 is as follows: SC represents the starting circuit number; EC represents the ending circuit number; INT represents the ON intensity; TON represents the circuit ON time; TOFF represents the circuit OFF time; BG represents the background intensity; D represents the sequence direction (Fwd or Rev); and LC represents the loop count.

TABLE 7

| EXAMPLES of MACRO SEQUENCES in the PREPROGRAMMED LIBRARY |
|---|
| FORMAT: NAME(Parameter List) |
| EXAMPLES: |
| 1) Single Chase: SCHASE(SC,EC,INT,TON,BG,D,LC) |
| 2) FLASH: FLASH(SC,EC,INT,TON,TOFF,BG,LC) |

The user could utilize the Single Chase sequence defined in Table 7, in the MACRO form SCHASE(1,4,100,0.2,0,F, 10) to produce the same lines of program code i.e. [CALL LOOP1,10], and subroutine [LOOP1 ] shown in Table 6.

Referring to FIG. 11, for the light controller 42 to be in the download configuration, AC power will be applied to the controller 42 via AC line cord 50 & 52 (FIG. 2), the controller power switch 70 will be ON, the RUN/HALT switch 86 will be in the HALT position, the PC serial interface port 274 will be connected to the controller serial interface 82 via serial cable 272 and the application program will be active on the personal computer 76.

Figure 12:
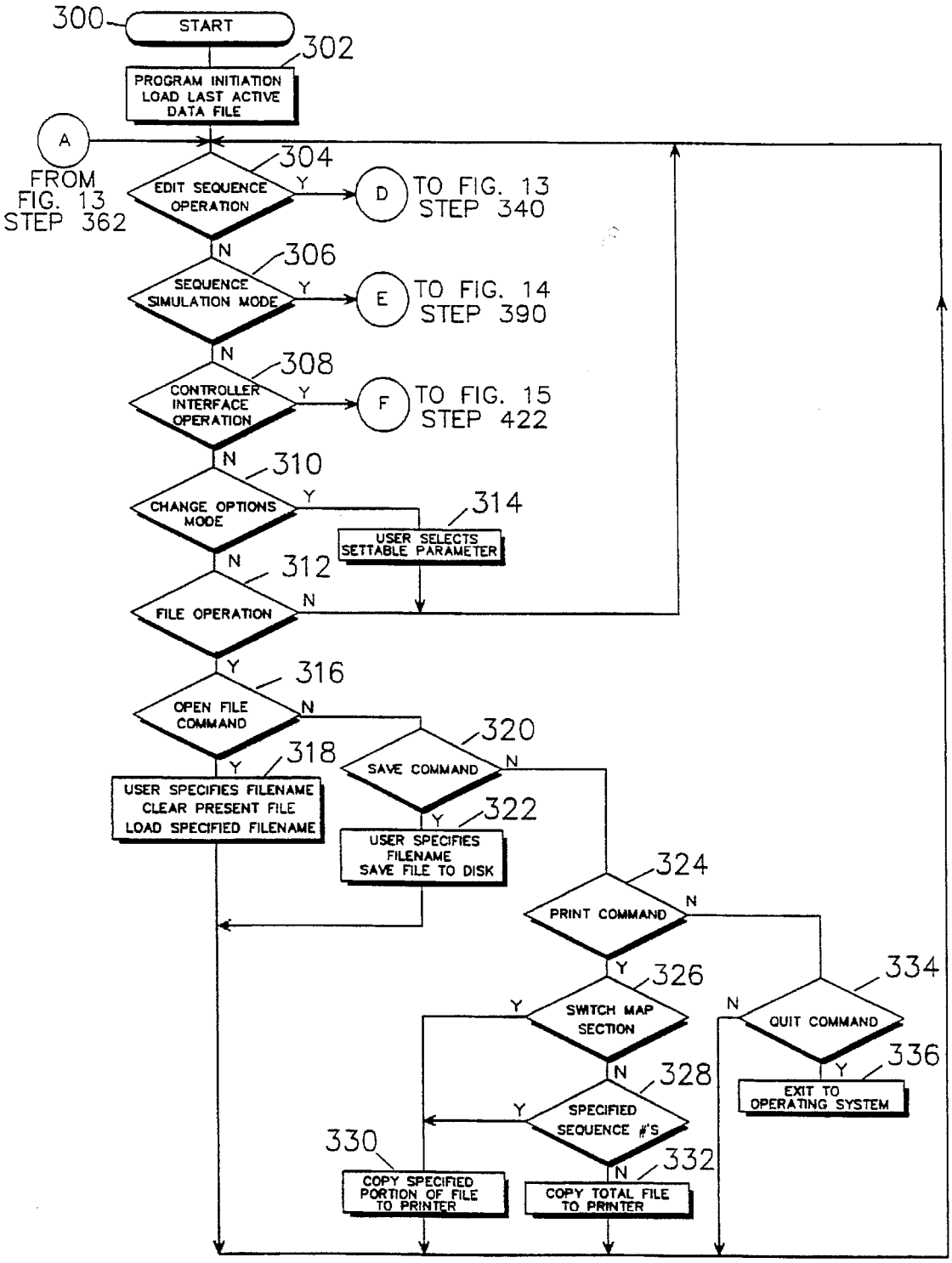
FIGS. 12–15 are computer flow diagrams, illustrating the operation of the present lighting controller application software.

The detail functional flow diagram of the application software is contained in FIG. 12, 13, 14, and 15. Referring to FIG. 12, upon program initiation 300 the program proceeds at step 302, to load the last active data file into the memory of the personal computer 76.

At step 304 a check is made to see if an edit sequence operation is requested by the user. If an edit operation is requested control passes to step 340 of FIG. 13. If an edit operation is not requested, control passes to step 306.

At step 306 a check is made to see if a sequence simulation operation is requested by the user. If a sequence simulation mode is requested, control passes to step 390 of FIG. 14. If a sequence simulation operation is not requested, control passes to step 308.

At step 308 a check is made to see if a controller interface operation is requested by the user. If an interface operation is requested, control is passed to step 422 of FIG. 15. If an interface operation is not requested, control is passed to step 310.

At step 310 a check is made to see if a change options operation is requested by the user. If a change options operation is requested, control is passed to step 314. If a change options operation is not requested, control is passed to step 312. At step 314 the user can select certain user preference options of the application program such as display 268 colors and the frequency of automatic file backup. Control passes to step 304.

At step 312 a check is made to see if a file operation is requested by the user. If a file operation is requested, control is passed to step 316. If a file operation is not requested, control is passed to step 304.

At step 316 a check is made to see if an open file command is requested by the user. If an open file command is requested by the user, control is passed to step 318. If an open file command is not requested by the user, control is passed to step 320. At step 318 the user specifies the filename, the application program clears the present data file and loads the specified file into memory. Control passes to step 304.

At step 320 a check is made to see if a save file command is requested by the user. If a save file command is requested by the user, control is passed to step 322. If a save file command is not requested by the user, control is passed to step 324. At step 322 the user specifies the filename, the application program saves the present data file to disk memory. Control passes to step 304.

At step 324 a check is made to see if a print operation is requested by the user. If a print operation is requested by the user, control is passed to step 326. If a print operation is not requested by the user, control is passed to step 334. At step 326 a check is made to see if only the switch map portion of the data file is to be printed. If only the switch map portion is to be printed, control passes to step 330. If the switch map portion is not selected, control passes to step 328. At step 328 a check is made to see if only user specified sequences are to be printed. If only user specified sequences are to be printed, control is passed to step 330. If individual sequences are not specified, control passes to step 332. At step 332 the total file is copied to the printer and control passes to step 304. At step 330 the specified portion of the file is copied to the printer and control passes to step 304.

At step 334 a check is made to see if a quit operation is requested by the user. If a quit operation is requested by the user, control is passed to step 336. If a quit operation is not requested, control passes to step 304. At step 336 the application program terminates, and returns control to the operating system of the PC.

Figure 13:
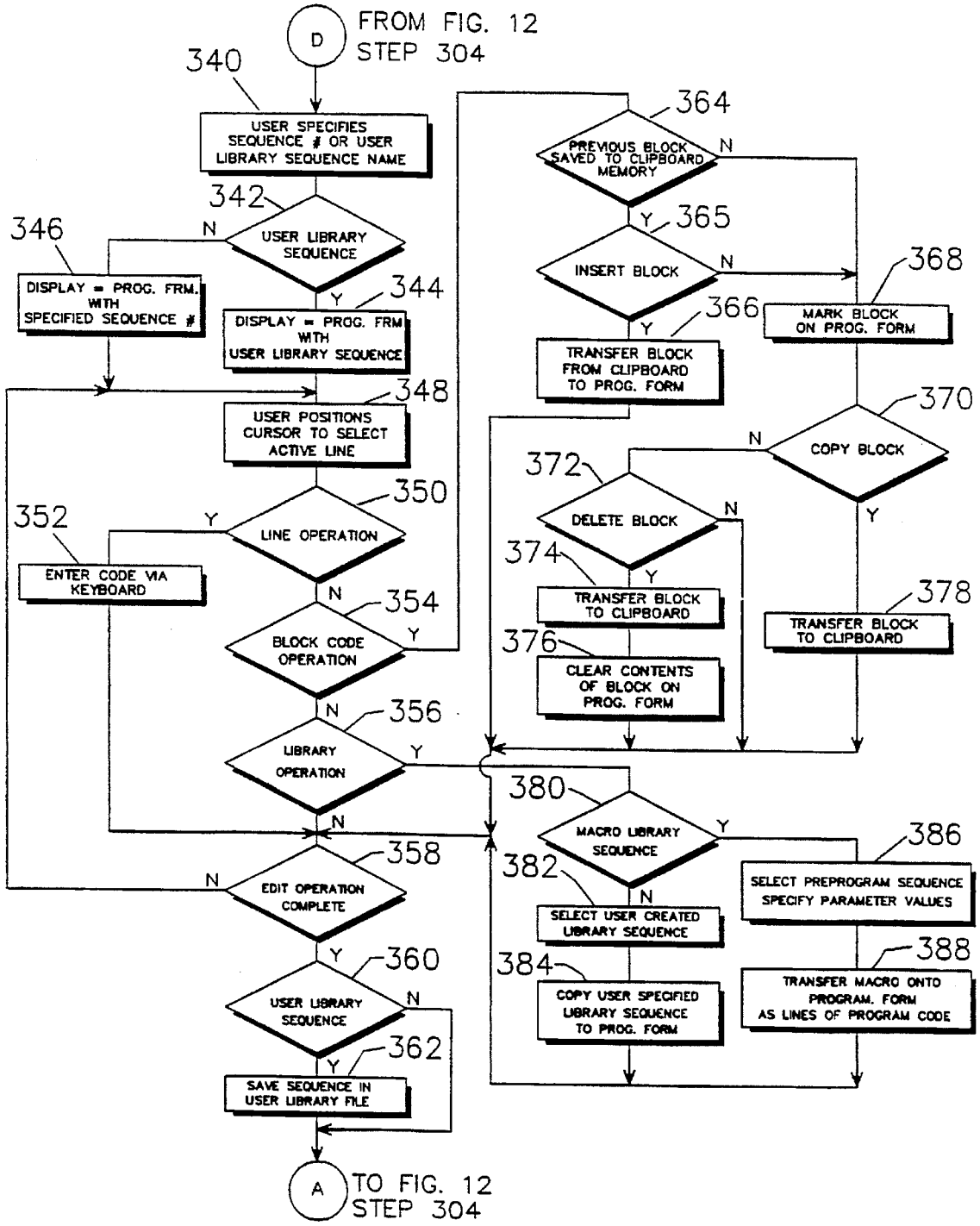

The details of the edit portion of the application program are illustrated in FIG. 13. Referring to FIG. 13, at step 340, the edit process begins when the user specifies either a sequence number or the name of a sequence in the user library. At step 342 a check is made to see if a library sequence is specified by the user. If a library sequence is specified, control passes to step 344. If a library sequence is not specified, control passes to step 346. At step 344 the display 268 contains the programming form Table 5 format, with the contents equal to the specified user library sequence. At step 346 the display 268 contains the programming form Table 5 format, with the contents equal to the specified sequence from the data file. At step 348 the user positions the cursor of display 268 to select the active line on the programming form.

At step 350 a check is made to see if a line operation is requested by the user. If a line operation is requested, control passes to step 352. If a line operation is not requested, control passes to step 354. At step 352 the user enters the program code via the keyboard 270 and control passes to step 358.

At step 354 a check is made to see if a block operation is requested by the user. If a block operation is requested, control passes to step 364. If a block operation is not requested, control passes to step 356.

At step 356 a check is made to see if a library, operation is requested by the user. If a library, operation is requested, control passes to step 380. If a library operation is not requested, control passes to step 358.

At step 380 a check is made to see if a macro library operation is requested by the user. If a macro library operation is requested, control passes to step 386. If a macro library operation is not requested, control passes to step 382. At step 386 the user selects a preprogrammed macro sequence and specifies values for the macro sequence. At step 388 the completed macro is transferred onto the program form (Table 5) as lines of program code and control passes to step 358. At step 382 the user selects a sequence from the user library. At step 384 the specified sequence is transferred onto the program form (Table 5) as lines of program code and control passes to step 358.

At step 358 a check is made to see if the edit operation is complete. If the edit operation is complete, control passes to step 360. If the edit operation is not complete, control passes to step 348.

At step 360 a check is made to see if a user library sequence was edited. If a user library sequence was edited, the sequence is saved in the user library at step 362 and control passes to step 304 of FIG. 12. If a user library sequence was not edited, control passes to step 304.

At step 364 a check is made to see if a previous block has been saved to clipboard memory of the program. Clipboard memory is a section of RAM 100 used to temporally store lines of text. If a previous block is on the clipboard, control passes to step 365. If a previous block is not on the clipboard, control passes to step 368.

At step 365 a check is made to see if an insert command is requested by the user. If an insert command is requested, control passes to 366. If an insert command is not requested, control passes to 368.

At step 366 the block stored on the clipboard is transferred to the programming form (Table 5) and control passes to step 358. At step 368 the user via the cursor of display 268 highlights a block of program code on the programming form (Table 5).

At step 370 a check is made to see if a copy block operation is requested by the user. If a copy block operation is requested, control passes to step 378. If a copy block operation is not requested, control passes to step 372. At step 378 the designated block is copied to the clipboard memory and control passes to step 358.

At step 372 a check is made to see if a delete block operation is requested by the user. If a delete block operation is requested, control passes to step 374. If a delete block operation is not requested, control passes to step 358. At step 374 the specified block is copied to the clipboard memory. At step 376 the contents of the specified block is cleared from the programming form and control passes to step 358. A block move operation consists of a delete block operation 372, followed by an insert block operation 365.

Figure 14:
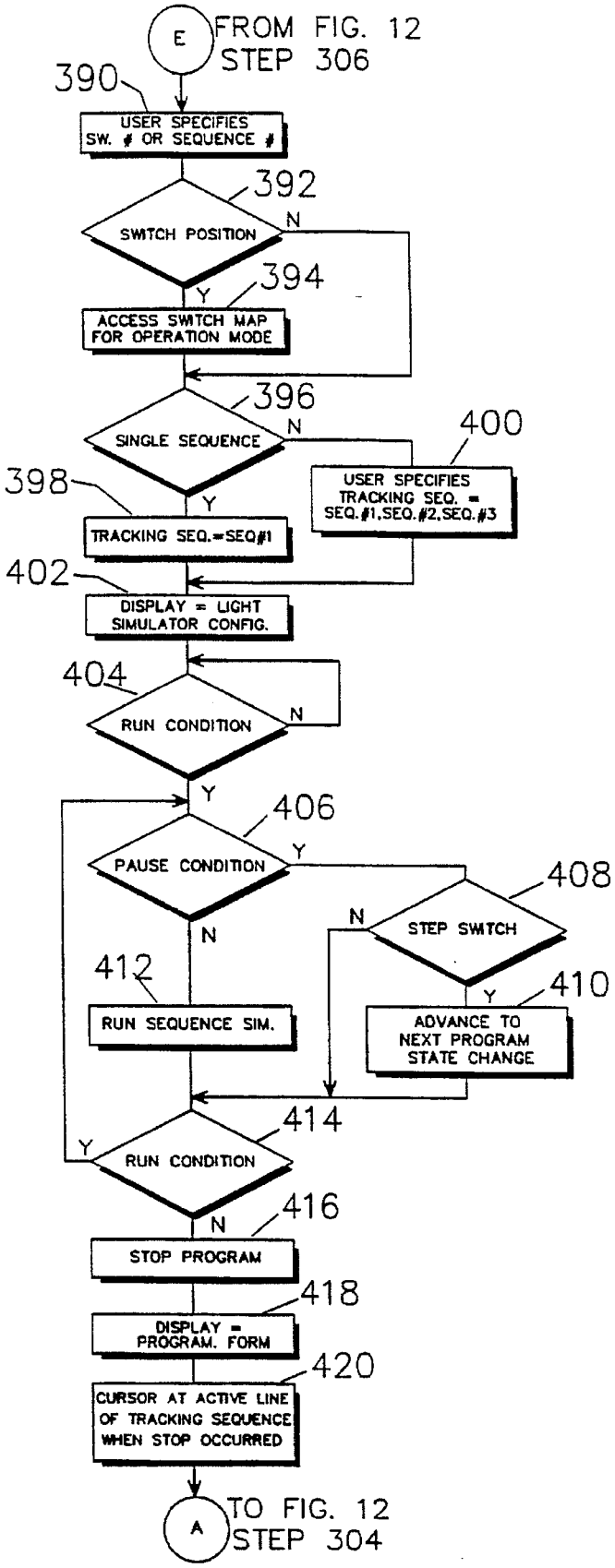

The details of the sequence simulation portion of the application program are illustrated in FIG. 14. Referring to FIG. 14, at step 390, the user specifies either a controller sequence select switch 106 position or a sequence number.

At step 392 a check is made to see if a switch position is specified. If a switch position is specified, control passes to step 394. If a switch position is not specified, control passes to step 396. At step 394 the switch map is accessed by the application program to determine the operation mode, single, dual or triple parallel sequence, and the associated programmed sequences (8 thru 24 ).

At step 396 a check is made to see if a single sequence is specified. If a single sequence is specified, control passes to step 398. If a single sequence is not specified, control passes to step 400. At step 400 the user has the option of specifying either the first, second, or third sequence as the tracking sequence, where the tracking sequence is the sequence displayed on the programming form (Table 5) when the simulation is stopped. At step 398 the first sequence becomes the tracking sequence. At step 402 the display 268 displays the format for the lighting simulation mode.

At step 404 the application program waits for the user to request a simulation RUN condition. If a RUN request has occurred, control passes to step 406.

At step 406 a check is made to see if the user has requested a simulation PAUSE condition. If a PAUSE request has occurred, control passes to step 408. If a PAUSE request has not occurred, control passes to step 412. At step 412 the selected sequence becomes operational and the display 268 displays an active visual simulation of the sequence. At step 408 a check is made to see if the user has requested a simulation STEP condition. If the STEP request has occurred, control passes to step 410. If the STEP request has not occurred, control passes to step 414. At step 410 the tracking sequence is advanced to the next lighting state.

At step 414 a check is made to see if the RUN simulation condition is still true. If a RUN condition still exists, control passes to step 406. If the RUN condition does not exist, a STOP condition exists, and control passes to step 416. At step 416 the sequence is stopped. At step 418 the display 268 displays the programming form (Table 5), with the display 268 cursor at the active line of the tracking sequence, when the stop occurred 420. Control passes to step 304 of FIG. 12.

Figure 15:
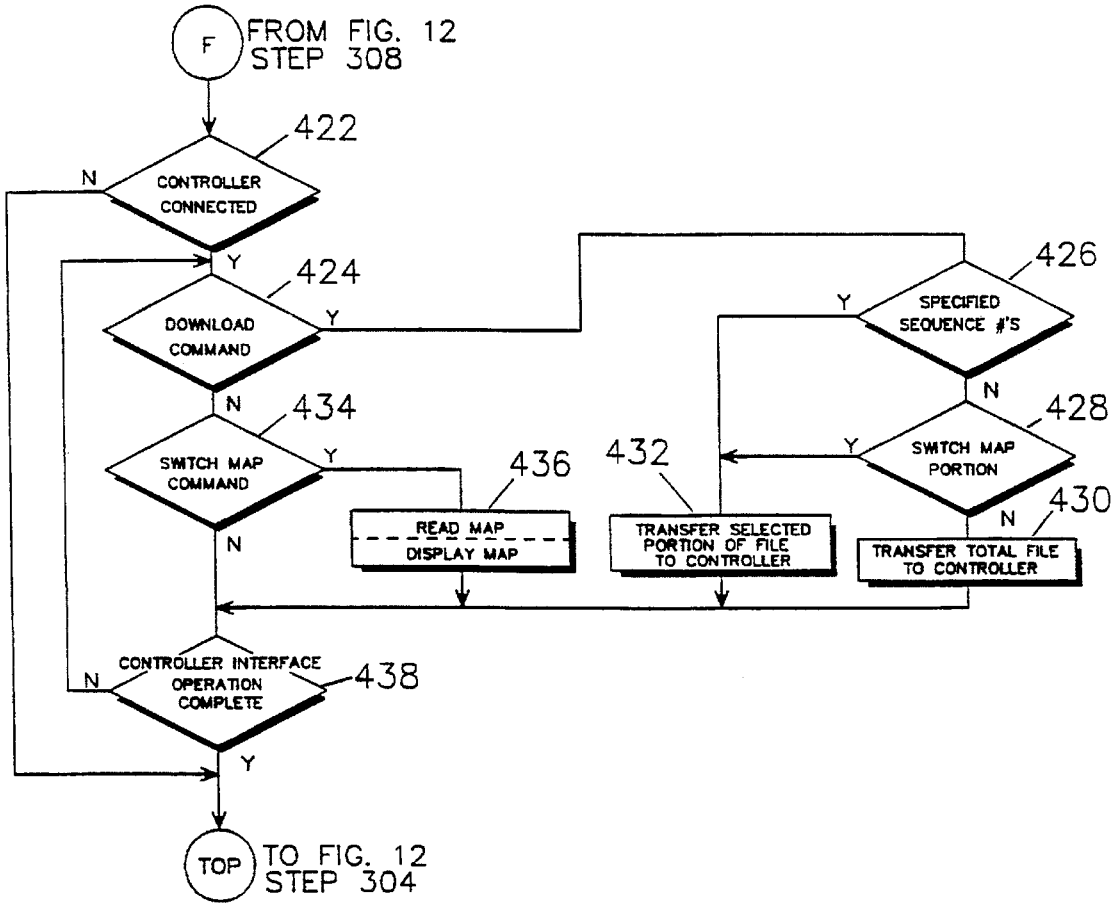

The details of the sequence simulation portion of the application program are illustrated in FIG. 15. Referring to FIG. 15, at step 422, a check is made to see if the light controller 42 is connected to the PC serial interface port 274. If the controller is connected, control passes to step 424. If the controller is not connected, control passes to step 304 in FIG. 12. At step 424 a check is made to see if the user has selected a download command. If a download command is selected, control passes to step 426. If a download command is not selected, control passes to step 434.

At step 426 a check is made to see if the user has specified a partial list of sequence numbers. If a partial list of sequence numbers has been specified, control passes to step 432. If a partial list of sequences has not been specified, control passes to step 428.

At step 428 a check is made to see if the user has specified the switch map portion of the data file. If the switch map portion has been selected, control passes to step 432. If the switch map portion has not been selected, control passes to step 430. At step 432 the specified portions of the data file are transferred to the light controller 42. At step 430 the total data file is transferred to the light controller 42 and control passes to step 438.

At step 434 a check is made to see if the user has specified the switch map command. If a switch map command is specified, control passes to step 436. If a switch map command is not specified, control passes to step 438. At step 436 the application program requests the controller for the current switch map data, stored in the non volatile memory 100, and displays the map information on the display 268.

At step 438 a check is made to see if the controller interface operation is complete. If the controller interface operation is complete, control passes to step 304 of FIG. 12. If the controller interface operation in not complete, control passes to step 424.

FIG. 16 shows the light controller 42, with the add-on prover booster device 450. The purpose of the power booster device 450 is to increase the individual circuit power capability of the light controller 42.

The total output power capability of the light controller 42 is limited either by the rating of the internal circuit breaker 56 or the power capability of the AC power circuit 64, which supplies power to the AC receptacle 54 via the controller power plug 50 and cord 52. The power capability of each of the individual AC receptacles 64.1 thru 64.8 of the light controller 42 is designed to not exceed the rating of the internal circuit breaker 58.

Referring to FIG. 16, the power booster device 450 contains an AC plug 452, and cord 454 which can be connected to any of the AC output receptacles 64.1 thru 64.8 of the light controller 42. The power booster device 450 also contains a second AC plug 458 and cord 456, which can be connected to a second AC receptacle 54, which receives power from a separate AC power circuit 466, and serves as the power source for the power booster 450 and the associated lighting load 68.1. The AC power circuits 464, 466, and 468 could be one circuit, dependent on the current rating of the user AC power circuits.

The power booster 450 can be installed on a single or multiple output circuits of the light controller 42, which allows the light controller individual circuit power capability to be increased beyond that determined by the circuit breaker 56. With the power booster installed, the power capability of an individual circuit is limited either by the power booster internal circuit breaker 460 or by the power capability of the AC power circuit 466.

Figure 17:
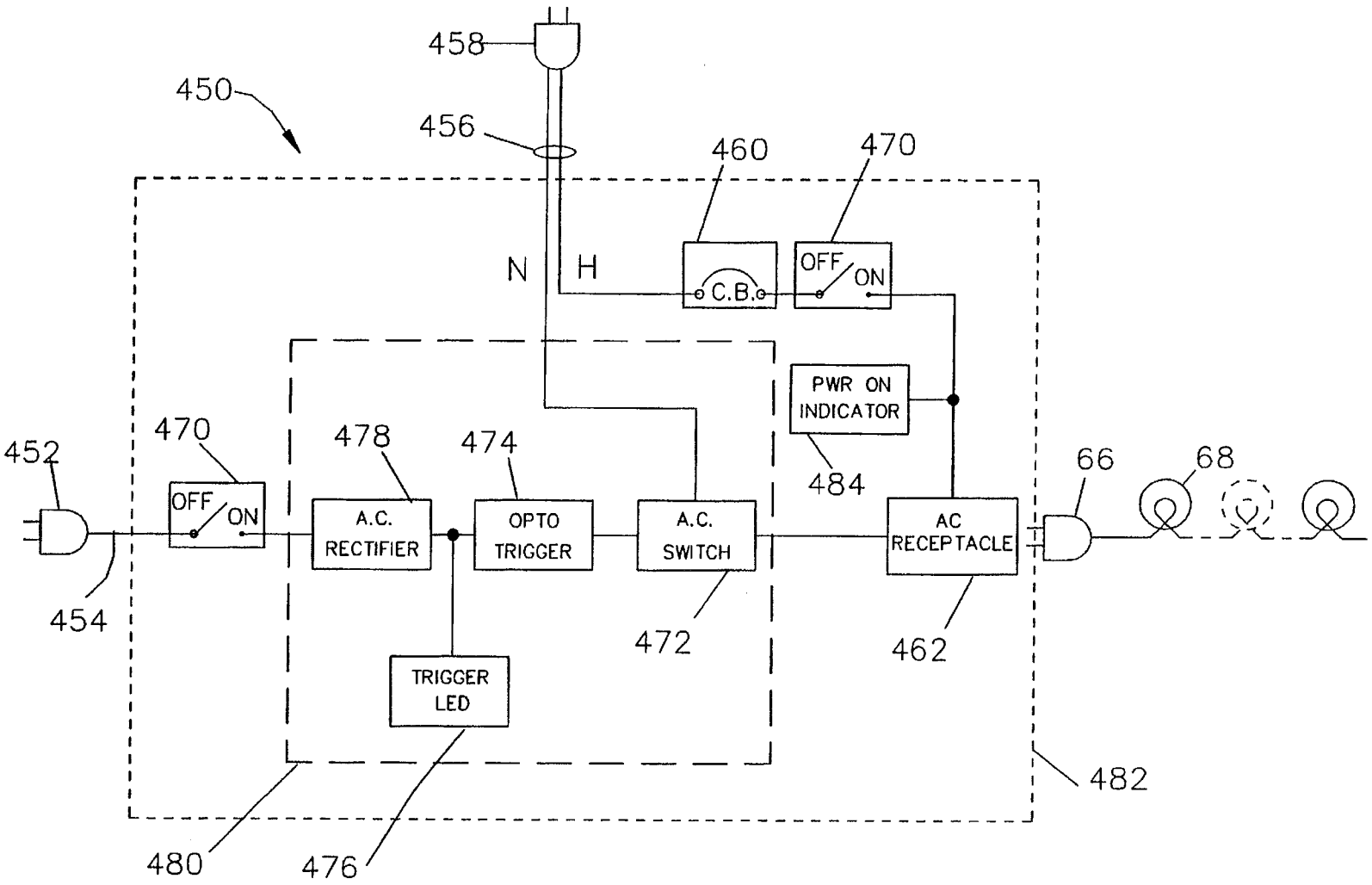
FIG. 17 is a detailed block diagram of the power booster device of the present invention.

FIG. 17 contains a detailed block diagram of the power booster device 450. The power booster device contains an AC plug 452 and AC power cord 454, which can be connected to any of the light controller AC output receptacles 64. This connection serves as the trigger signal from the light controller 42 to the power booster device 450, and signals the power booster device 450 when to turn ON. The power booster device 450 also contains a second AC plug 458 and AC power cord 456, which can be connected to a AC receptacle 54, and serves as the power source for the power booster device 450 and the associated lighting load 68.

Circuit breaker 460 provides the main overcurrent protection means for the power booster device 450 and is connected in series with the power switch 470, which is in series with the AC power circuit, which is connected to the AC output receptacle 462. The power on indicator 484 provides a visual indication that power is applied to the power booster device 450. The power ON/OFF switch 470 interrupts both the main power source and also the trigger source.

The power booster device 450 contains an AC full wave rectifier bridge 478, which rectifies the AC trigger source signal and applies it to an OPTO isolated trigger circuit 474 and LED indicator 476, which provides a visible indication of the presence of a trigger signal.

Inside the power booster enclosure 482, the trigger signal from the light controller 42, passes through the AC rectifier 478, and triggers the OPTO isolated trigger circuit 474, which causes the AC switch 472 to turn ON. The power booster electronics, consisting of switch 472, circuit 474, and rectifier 478 are contained on a printed circuit board 480. When the AC switch 472 is turned ON, power is applied to the AC lighting load 68 via the output AC receptacle 462.

The present light controller 42 is not limited by a particular type of microprocessor and other components, the number of AC output circuits, the number of parallel sequences operating simultaneously, the number or size of the programmable sequences, the size of the non volatile memory, the number of positions on the sequence select switch, the power capability of the individual output circuits, the type or method of AC output connection, or the type and style of the enclosure.

The power booster device 450 of the present invention is not limited by the type of components, the type or method of the trigger connection, the number of AC output circuits contained within a single device, the power capability of the device, the type or method of AC output connection, or the type and style of the enclosure.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A lighting control device programmable by a user for the control of a plurality of lighting strings, each lighting string including a plurality of lamps, the device providing selection of individual lighting conditions of illumination duration and intensity level for each of the lamps, the device comprising:

energizing means connected to the plurality of lighting strings for energizing each of the lighting strings independent of each other for selectively controlling the illumination duration and intensity level of the plurality of lamps of each of the lighting strings;

control means for selectively controlling said energizing means to control the illumination duration and intensity level of each of the plurality of lamps in each of the lighting strings, said control means including a single controller for generating control signals which independently determine, for each of the plurality of lighting strings, illumination duration and intensity levels for each of the plurality of lamps in each of the plurality of lighting strings and simultaneously control the lighting conditions of all of the plurality of lighting strings; and user input means for generating programmable control signals applied to said control means for activating said control means, said programmable control signals determining illumination duration and intensity levels of each of the plurality of lamps in each of the lighting strings and being programmable by the user.

2. The lighting control device of claim 1 and further including:

memory means for storing said programmable control signals generated by the user.

3. The lighting control device of claim 2 and further including:

means for storing said programmable control signals arranged in a plurality of unique sequences for creating a unique lighting condition of illumination duration and intensity levels for a lighting string over a time period.

4. The lighting control device of claim 3 and further including:

means operable by the user for selecting one of said plurality of unique sequences for controlling said control means during a selected time period for energizing one of said plurality of lighting strings.

5. The lighting control device of claim 3 and further including:

means programmable and operable by the user for selecting multiple ones of said plurality of unique sequences for controlling said control means during a selected time period for simultaneously energizing ones of said plurality of lighting strings.

6. The lighting control device of claim 2 wherein said user input means includes:

personal computing means for generating and storing programmable control signals generated by the user.

7. The lighting control device of claim 6 and further including:

means for transferring programmable control signals stored in said personal computing means to said memory means of the lighting control device.

8. The lighting control device of claim 6 and further including:

means for energizing said plurality of lighting strings during generation by the user of said programmable control signals using said personal computing means.

9. The lighting control device of claim 1 and further including:

means for storing predetermined control signals for determining illumination duration and intensity levels of each of the plurality of lamps in each of the lighting strings and being nonprogrammable by the user.

10. The lighting control device of claim 9 and further including:

means for storing said predetermined control signals in a plurality of unique sequences for creating a unique lighting condition of illumination duration and intensity levels for a lighting string over a time period.

11. The lighting control device of claim 10 and further including:

means operable by the user for selecting one of said plurality of unique sequences for controlling said control means during a selected time period for energizing one of said plurality of lighting strings.

12. The lighting control device of claim 10 and further including:

means operable by the user for selecting multiples ones of said plurality of unique sequences for controlling said control means during a selected time period for simultaneously energizing at least one of said plurality of lighting strings.

13. A lighting control device programmable by a user for the control of a plurality of lighting strings, each lighting string including a plurality of lamps, the device providing selection of individual lighting conditions of illumination duration and intensity level for each of the lamps, the device comprising:

energizing means connected to the plurality of lighting strings for energizing each of the lighting strings independent of each other for selectively controlling the illumination duration and intensity level of the plurality of lamps of each of the lighting strings;

control means for selectively controlling said energizing means to control the illumination duration and intensity level of each of the plurality of lamps in each of the lighting strings, said control means including a single controller for generating control signals which independently determine, for each of the plurality of lighting strings, illumination duration and intensity levels for each of the plurality of lamps in each of the plurality of lighting strings and simultaneously control the lighting conditions of all of the plurality of lighting strings;

user input means for generating programmable control signals applied to said control means for activating said control means, said programmable control signals determining illumination duration and intensity levels of each of the plurality of lamps in each of the lighting strings and being programmable by the user;

means for storing said programmable control signals arranged in a plurality of program unique sequences for creating a unique lighting condition of illumination duration and intensity levels for a lighting string over a time period; and means for storing predetermined control signals for determining illumination duration and intensity levels of each of the plurality of lamps in each of the lighting strings and being nonprogrammable by the user, said predetermined control signals being stored in a plurality of nonprogrammed unique sequences for creating a unique lighting condition of illumination duration and intensity levels for a lighting string over a time period.

14. The lighting control device of claim 13 and further including:

means operable by the user for selecting at least one of said program unique sequences and at least one of said nonprogrammed unique sequences for controlling said control means during a selected time period for energizing at least one of said plurality of light strings.

15. The lighting control device of claim 13 and further including:

means programmable and operable by the user for selecting at least one of said program unique sequences and at least one of said nonprogrammed sequences for controlling said control means during a selected time period for simultaneously energizing at least one of said plurality of light strings.

16. The lighting control device of claim 13 wherein said user input means includes:

personal computing means for generating and storing programmable control signals generated by the user.

17. The lighting control device of claim 16 and further including:

means for transferring programmable control signals stored in said personal computing means to said memory means of the lighting control device.

18. The lighting control device of claim 13 and further including:

means for storing combined unique sequences; and means programmable and operable by the user for selecting a combined unique sequence.

19. The lighting control device of claim 13 and further including an auxiliary power supply for said means for storing said programmable control signals.

20. The lighting control device of claim 13 and further including:

means for selecting multiple ones of said plurality of program unique sequences in an order programmable by the user to generate unique sequences not stored as a sequence in said means for storing said programmable control signals.

21. A lighting control device programmable by a user for the control of a plurality of lighting strings, each lighting string including a plurality of lamps, the device providing selection of individual lighting conditions of intensity level for each of the lamps, the device comprising:

energizing means connected to the plurality of lighting strings for energizing each of the lighting strings independent of each other for selectively controlling the intensity level of the plurality of lamps of each of the lighting strings;

control means for selectively controlling said energizing means to control the intensity level of each of the plurality of lamps in each of the lighting strings;

user input means for generating programmable control signals applied to said control means for activating said control means, said programmable control signals determining intensity level of each of the plurality of lamps in each of the lighting strings and being programmable by the user; and means interconnected to said energizing means for increasing power available to a lighting string including means for sensing the voltage phase of said energizing means.

22. The lighting control device of claim 21 and further including:

means for storing said programmable control signals arranged in a plurality of program unique sequences for creating a unique lighting condition of intensity level for a lighting string over a time period; and means for storing predetermined control signals for determining intensity levels of each of the plurality of lamps in each of the lighting strings and being nonprogrammable by the user, said predetermined control signals being stored in a plurality of nonprogrammed unique sequences for creating a lighting condition of intensity levels for a lighting string over a time period.

23. The lighting control device of claim 21 and further including:

means interconnected to said energizing means for testing the power requirements of said lighting strings.

* * * * *